US010356522B2

(12) United States Patent
Lawrence et al.

(10) Patent No.: US 10,356,522 B2
(45) **Date of Patent: *Jul. 16, 2019**

(54) LOUDSPEAKER PROTECTION

(71) Applicant: Cirrus Logic International Semiconductor Ltd., Edinburgh (GB)

(72) Inventors: Jason William Lawrence, Austin, TX (US); Roberto Napoli, Milan (IT); Roger Serwy, Austin, TX (US); Jie Su, Austin, TX (US); Stefan Williams, London (GB); Rong Hu, Austin, TX (US); Firas Azrai, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/547,850

(22) PCT Filed: Feb. 1, 2016

(86) PCT No.: PCT/GB2016/050214

§ 371 (c)(1),
(2) Date: Aug. 1, 2017

(87) PCT Pub. No.: WO2016/124896

PCT Pub. Date: Aug. 11, 2016

(65) Prior Publication Data

US 2018/0014121 A1 Jan. 11, 2018

Related U.S. Application Data

(60) Provisional application No. 62/110,865, filed on Feb. 2, 2015.

(51) Int. Cl.
*H04R 3/00* (2006.01)
*H04R 29/00* (2006.01)
(Continued)

(52) U.S. Cl.
CPC ..... *H04R 3/007* (2013.01); *G10L 21/0272* (2013.01); *H04R 3/04* (2013.01); *H04R 29/001* (2013.01); *H04R 2430/01* (2013.01)

(58) Field of Classification Search
None
See application file for complete search history.

(56) References Cited

U.S. PATENT DOCUMENTS 6,865,274 B1 * 3/2005 Aarts ..... H04R 3/007 381/55
2002/0118841 A1 * 8/2002 Button ..... H04R 3/00 381/55

(Continued)

FOREIGN PATENT DOCUMENTS

CN 1196863 A 10/1998
CN 1308833 A 8/2001

(Continued)

OTHER PUBLICATIONS

International Search Report and Written Opinion of the International Searching Authority, International Application No. PCT/GB2016/050215, dated Apr. 8, 2016.

(Continued)

*Primary Examiner* — Qin Zhu
(74) *Attorney, Agent, or Firm* — Jackson Walker L.L.P.

(57) ABSTRACT

This application describes methods and apparatus for loudspeaker protection. A loudspeaker protection system (100) is described having a first frequency band-splitter (102) for splitting an input audio signal (Vin) into a plurality of audio signals (v1, v2 . . . , vn) in different respective frequency bands (ω1, ω2 . . . , ωn). A first gain block (103) is configured to apply a respective frequency band gain (g1, g2 . . . , g3) to each of the audio signals in the different respective frequency bands and a gain controller (107, 108, 109) is provided for controlling the respective band gains. A (Continued)

displacement modeller (104, 105) determines a plurality of displacement signals (x1, x2 . . . , xn) based on the input audio signal (Vin) and a displacement model (104*a*) where each displacement signal corresponds to a modelled cone displacement for the loudspeaker for one of said different respective frequency bands. The gain controller (107, 108, 109) is configured to control the respective frequency band gains based on the plurality of displacement signals.

20 Claims, 16 Drawing Sheets

(51) Int. Cl.
*H04R 3/04* (2006.01)
*G10L 21/0272* (2013.01)

(56) References Cited

U.S. PATENT DOCUMENTS

2009/0268918 A1 10/2009 Solgaard et al.
2012/0207314 A1* 8/2012 Gautama ..... H04R 3/002 381/55
2012/0328117 A1* 12/2012 Gautama ..... H03F 1/52 381/59
2014/0146971 A1* 5/2014 Marguery ..... H04R 3/007 381/55
2014/0254805 A1* 9/2014 Su ..... H04R 3/007 381/55
2014/0341394 A1 11/2014 Croft, III
2015/0124982 A1* 5/2015 Berthelsen ..... H04R 29/001 381/59
2015/0304772 A1* 10/2015 Risberg ..... H04R 3/002 381/55
2016/0157015 A1* 6/2016 Van Schyndel ..... H04R 3/007 381/55
2016/0173983 A1* 6/2016 Berthelsen ..... H04R 3/007 381/55

FOREIGN PATENT DOCUMENTS

CN 1525773 A 9/2004
CN 102404672 A 4/2012
CN 103299655 A 9/2013
WO 01/03466 A2 1/2001
WO 2004/023645 A2 3/2004
WO 2004/051846 A2 6/2004
WO 2014/045123 A2 3/2014

OTHER PUBLICATIONS

International Search Report and Written Opinion of the International Searching Authority, International Application No. PCT/GB2016/050214, dated Apr. 7, 2016.
Combined Search and Examination Report under Sections 17 and 18(3), Application No. GB1510031.6, dated Sep. 11, 2015.
Combined Search and Examination Report under Sections 17 and 18(3), Application No. GB1510030.8, dated Sep. 11, 2015.
First Office Action, China National Intellectual Property Administration, Application No. 2016800203588, dated Apr. 30, 2019.
Search Report, China National Intellectual Property Administration, Application No. 2016800203588, dated Apr. 19, 2019.
First Office Action, China National Intellectual Property Administration, Application No. 2016800203624, dated Apr. 30, 2019.
Search Report, China National Intellectual Property Administration, Application No. 2016800203624, dated Apr. 19, 2019.

* cited by examiner

LOUDSPEAKER PROTECTION

The field of representative embodiments of this disclosure relates to methods, apparatuses and/or implementations concerning or relating to protecting loudspeakers, and especially to controlling the drive signal supplied to a loudspeaker so as to avoid excessive diaphragm excursion and/or overheating of the voice coil.

A number of different products include audio circuitry, such as an audio amplifier, together with one or more loudspeakers and/or connections for driving one or more loudspeakers of an integrated apparatus such as a mobile phone, i.e. handset, and/or peripheral apparatus such as a headset, e.g. earbuds, headphones, headsets, hearing aids and Bluetooth™ devices. In some instances the loudspeaker(s) chosen will be robust enough and sized sufficiently to handle the maximum power level at which the amplifier could drive signals continuously into it, even under the worst case environmental conditions, for instance maximum supply voltage, maximum ambient temperature etc. However having robust enough loudspeakers is not always economical, and for portable devices such as mobile phones or tablets and headsets and the like the desire is typically to make the speaker as small and light as possible. This can potentially lead to the audio drive circuitry overloading the loudspeaker. One particular problem is mechanical damage due to excessive displacement, i.e. excursion, of the speaker mechanism caused by the excessive and/or prolonged drive signals.

It is known to provide circuitry to estimate the displacement of a speaker mechanism over time from the voltage applied to the speaker using a plant model, i.e. a model of how the speaker reacts, whose parameters may be adapted in use, and to reduce the applied drive signal if over-excursion is predicted. This signal reduction may attenuate the input signal driving the speaker across its full bandwidth or it may alter the cut-off frequency of a high-pass filter to reduce the lower frequency or bass components which are generally of larger magnitude. However these full-band attenuation or variable-cut-off filtering techniques may unnecessarily attenuate some components of the input signal in frequency bands that are not contributing significantly to the excursion modulation, causing unnecessary degradation of the acoustic signal from the loudspeaker.

Also the over-excursion prediction and signal reduction must be rapid enough to reliably reduce the signal before any over-excursion occurs yet not produce noticeable artifacts in the audio signal due to frequent changes in the modulation of the signal. Preferably there should be no unnecessary signal processing in the signal path from the signal input to speaker drive signal, i.e. signal output, so as to preserve the subjective audio quality and to be economical in hardware resources required and economical in power consumption. Also in some applications such as telephony the signal processing should not introduce excessive delay between the input signal and output signal.

A further issue is that the speaker may also be damaged by excessive temperature. Even if the signal amplitude is limited so as to not mechanically overload the speaker, the ohmic power dissipation in the coil of the speaker may be enough to produce excessive temperature inside the speaker, especially if this signal power is sustained over a relatively long period of time or if the external environmental or the apparatus temperature is already elevated. Thus, in some instances it may be necessary to attenuate the drive signal in order to reduce coil power dissipation. This attenuation may be provided by a separate signal attenuation or gain block, i.e. a module specific for thermal limiting. Such a signal attenuation block for thermal limiting may operate in the signal path either before or after the excursion limiting block, but there is a risk of these blocks interacting in an unwanted fashion, for instance to provide erroneous estimates of the excursion or temperature, and/or to operate with conflicting gain adjustment attack or release times resulting in over-active adjustment or audible artifacts.

The audio signal may also, in some applications, be adjusted at some point in a signal chain, i.e. signal path, by a dynamic range compressor (DRC) block in order to boost low-level signals and/or attenuate high-amplitude signals so as to fit inside the dynamic range of circuit elements in the signal chain e.g. signal processing blocks of the signal chain. This dynamic range adjustment may also be signal dependent and incorporate some attack and decay time constants. There may also be some adjustment to balance the frequency spectrum, so as to exaggerate bass signals and/or to increase subjective loudness according to psychoacoustic parameters.

Each of these cascaded blocks in the signal path may introduce filter group delay and processing delay to the signal, and the chain of adaptive adjustments of gain and/or frequency response may interact via their individual adjustment time constants.

Embodiments of the present invention provide methods and apparatus for speaker protection that at least mitigate at least some of the above mentioned disadvantages.

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiments discussed below, and all such equivalents should be deemed as being encompassed by the present disclosure.

Thus according to an aspect of the present invention there is provided a loudspeaker protection system comprising:

- a first frequency band-splitter configured to receive an input audio signal and split said input audio signal into a plurality of audio signals in different respective frequency bands;
- a first gain block configured to apply a respective frequency band gain to each of said plurality of audio signals in different frequency bands;
- a gain controller for controlling said respective frequency band gains; and
- a displacement modeller configured to determine a plurality of displacement signals based on said input audio signal and a displacement model, each displacement signal corresponding to a modelled cone displacement for the loudspeaker for one of said different respective frequency bands;
- wherein said gain controller is configured to control said respective frequency band gains based said plurality of displacement signals.

The gain controller may be configured to control said band gains so as to maintain the loudspeaker within defined limits of excursion. In other words the loudspeaker protection system provides excursion limiting.

The displacement modeller may comprise a displacement modelling block configured to receive an audio waveform signal and determine a predicted displacement for the loudspeaker based on the audio waveform signal and the displacement model.

In some embodiments the audio waveform is a version of the input audio signal. Thus the displacement modelling block may be configured to receive a version of said input audio signal. The system may comprise a second frequency band-splitter configured to receive the output of the displacement modelling block and split the output into the plurality of displacement signals in different frequency bands, wherein said frequency bands of the second frequency band-splitter correspond to the frequency bands of the first frequency band-splitter. The second frequency band-splitter may comprise a filter-bank of band-pass filters. In some embodiments the second band-splitter may comprise a rectifier to apply rectification in each frequency band, i.e. to rectify the signal in each band, to provide said plurality of displacement signals. The second frequency band-splitter may additionally or alternatively be configured to process the displacement signal in each frequency band so as to provide at least one of: an attack time constant; a decay time constant; or an indication of maximum displacement in a frame period.

In some embodiments the displacement modelling block is configured to receive the plurality of audio signals output from the first frequency band splitter and determine a modelled cone displacement for each of said audio signals output from said first frequency band splitter to provide the plurality of displacement signals in the different frequency bands.

The loudspeaker protection system may comprise a second gain block configured to apply a respective gain to each of said plurality of displacement signals in different frequency bands.

In some embodiments the respective gain applied to each of said plurality of displacement signals (by the second gain block) may be based on the then present band gain corresponding to that frequency band as determined by the gain controller.

In some embodiments however the system may further comprise a multi-band dynamic range control block and the respective gain applied to each of said plurality of displacement signals is based on a dynamic range control gain for the relevant frequency band determined by said multi-band dynamic range control block.

The multi-band dynamic range control block may receive a version of the plurality of audio signals from the first frequency band-splitter to determine the dynamic range control gains. In this case a delay block may be located in the signal path for the plurality of the audio signals, wherein the delay block is downstream of the first frequency band-splitter and upstream of the first gain block and wherein the multi-band dynamic range control block receives a version of the plurality of audio signals that is derived from upstream of the delay block. For at least some of the plurality of audio signals from the first frequency band splitter, the multi-band dynamic range control block may be configured to combine the audio signal in one frequency band with at least one audio signal of an adjacent frequency band and process the combined audio signal to determine a dynamic range control gain for the respective frequency bands.

The multi-band dynamic range control block may instead receive a version of said plurality of displacement signals and determines the dynamic range control gains from said displacement signals. In some embodiments, for at least some of the plurality of displacement signals, the multi-band dynamic range control block is configured to combine the displacement signal in one frequency band with at least one displacement signal of an adjacent frequency band and process the combined displacement signal to determine a dynamic range control gain for the respective frequency bands.

Where the multi-band dynamic range control block receives the displacements signals, or there is no multi-band dynamic range control block, the loudspeaker protection system may comprise a delay block in a main audio signal path between an input for the input audio signal and an output for an output audio signal, wherein the delay block is upstream of the first gain block. The delay block may be upstream of the first frequency band-splitter.

In some embodiments an over-excursion detector may be configured to determine whether an overall predicted cone excursion for said loudspeaker, based on said plurality of displacement signals after the respective gain has been applied by said second gain block, is or will exceed at least one threshold. The over-excursion detector may be configured to receive and combine said plurality of displacement signals after the respective gain has been applied to determine the overall predicted cone excursion for said loudspeaker.

In some embodiments the gain controller is configured to control the band gain setting for each frequency band based on the displacement signal for that frequency band, e.g. to prevent over-excursion. The gain controller may be configured to control said band gains to maximise a sum of the band gains subject to remaining within an acceptable excursion limit and/or configured to apply iterative error minimisation techniques to control said band gains. In some embodiments the gain controller may be configured to identify a threshold of cone displacement based on the plurality of displacement signals and to control the band gains so that, for any frequency band where the displacement signal corresponds to a predicted cone displacement greater than the threshold, the gain for said frequency band is controlled to reduce the predicted cone displacement to be substantially equal to the threshold. The gain controller may be configured to apply a weighting to the contribution from one or more frequency bands.

In some embodiments the gain controller may be configured so as to apply any change in gain in accordance with at least one of: a time constant for decreasing a gain; a time constant for increasing a gain; a hold time for maintaining a gain before increasing the gain; and a hold time for maintaining a gain before decreasing the gain.

The first frequency band-splitter may comprise a filter band comprising a plurality of band-pass filters.

In some embodiments at least one frequency band of the plurality of audio signals output from the first frequency band splitter corresponds to a non-excursion limited frequency band where the respective band gain is not based on said plurality of displacement signals. In other words the band gain applied to at least one of the frequency bands may not be controlled for the purposes of excursion limiting.

The at least one non-excursion limited frequency band may correspond to the highest frequency band or bands output from the first frequency band splitter. The band gain for the at least one non-excursion limited frequency band may still be controlled in use, for instance based on a dynamic range gain setting generated by a multi-band dynamic range controller.

In some embodiments the loudspeaker protection system may also provide for thermal protection of the loudspeaker, e.g. to provide protection from thermal overload and/or maintain the loudspeaker within acceptable temperature limits.

In some embodiments therefore the loudspeaker protection system may comprise a thermal controller configured to determine a power dissipation for said loudspeaker in each of a plurality of thermal frequency bands and determine, for each thermal frequency band, a respective thermal gain setting based on the determined power dissipation for that frequency band.

At least some of the thermal frequency bands may correspond to the frequency bands of the plurality of audio signals output from the first band-splitter. In other words at least some of the frequency bands for which a thermal gain setting is determined for thermal protection may correspond to frequency bands for which a band gain setting is determined for excursion protection. The gain controller may thus be configured to control the band gains based on the displacement settings and also based on the determined power dissipation for the loudspeaker for the frequency bands.

In such embodiments the gain controller may comprise: an excursion gain calculation block for determining an excursion gain setting for each frequency band; and a minimum function block configured to receive, for each frequency band, the excursion gain setting and thermal gain setting as gain setting inputs and determine the relevant band gain based on the minimum gain setting input for that frequency band. The minimum function block may be further configured to receive, for each frequency band, at least one additional control gain setting as a gain setting input.

The system may comprise a multiplier block configured to multiply said plurality of audio signals by a respective impedance value for the respective frequency band to provide the indication of power dissipation for each of said frequency bands. The impedance value may be based on a predetermined average coil impedance for that frequency band.

In some embodiments at least one of the thermal frequency bands may not correspond to any frequency band of the plurality of audio signals output from the first band-splitter, in other words thermal protection may be applied to at least one frequency band that does not correspond to a frequency band of any of the plurality of audio signals output from the first frequency band-splitter.

The thermal controller may be configured to receive a signal indicative of voice coil current of the loudspeaker and determine an estimate of power dissipation in each thermal frequency band based on a current component for each thermal frequency band and a estimate of voice coil resistance. The thermal controller may comprise a third band-splitter for splitting the signal indicative of voice coil current of the loudspeaker into current components in each of the thermal frequency bands.

The thermal controller may be configured to determine the estimate of voice coil resistance based on the signal indicative of voice coil current of the loudspeaker.

In some embodiments the thermal controller may be configured to determine an estimate of voice coil temperature and set at least one allowed power limit based on the estimated temperature. The thermal gain setting for a thermal frequency band may be controlled based on the determined power dissipation for that band and the at least one allowed power limit.

The thermal gain controller may be configured to determine whether one or more temperature thresholds is or will be exceeded based on said power dissipation for said loudspeaker for each of said thermal frequency bands and to control the band gains applied. If the one or more temperature thresholds is or will be exceeded, the thermal gain settings may be controlled to reduce the power dissipation for the thermal frequency bands.

The loudspeaker protection system may thus provide both excursion limiting and thermal protection and in such case the gain controller may be configured to generate respective band gains for the frequency bands based on a modelled cone displacement for said loudspeaker for each of said frequency bands and the determined power dissipation in each frequency band.

The input audio signal may an analogue audio signal or a digital audio signal.

Embodiments relate to a loudspeaker protection system as described above implemented as an integrated circuit.

Embodiments also relate to an audio circuit comprising a loudspeaker protection system as described above and having at least first and second signal paths between an input node and an output node with a path splitter for splitting a signal received at the input node into a respective signal component in each said signal path, wherein the loudspeaker protection system is located in the first signal path such that the input audio signal received at the first band splitter corresponds to a first signal component. The path splitter may comprise a band-splitter configured such that the first signal component is below a cut-off frequency and the signal component in the second signal path is above the cut-off frequency. In some embodiments the circuit may further comprise a dynamic range controller for controlling a gain applied to the signal component in the second signal path. In some embodiments the first signal path may comprise a down-sampler located upstream of the loudspeaker protection system and an up-sampler located downstream of the loudspeaker protection system.

Aspects of the invention also relate to electronic apparatus comprising a loudspeaker protection system as described in any of the variants above or the audio circuit including the loudspeaker protection system. The electronic apparatus may further comprising a drive amplifier for a loudspeaker configured to receive an audio signal output from the loudspeaker protection system and/or a loudspeaker configured to be driven by an audio signal output from the loudspeaker protection system.

The apparatus may be at least one of: a portable device; a battery power device; a computing device; a communications device; a gaming device; a mobile telephone; a personal media player; a laptop, tablet or notebook computing device.

In a further aspect there is provided a method of loudspeaker protection comprising:

- receiving an input audio signal;
- splitting said input audio signal into a plurality of audio signals in different frequency bands; and
- applying a respective band gain to each of said plurality of audio signals in different frequency bands;
- wherein the method comprises determining a modelled cone displacement for the loudspeaker for each of a plurality of said frequency bands; and
- controlling said band gains based on said modelled cone displacement for said frequency bands.

Aspects also relate to software code stored on a non-transitory storage medium which, when run on a suitable processor, performs the method described above or provides the loudspeaker protection system according to any of the variants described above.

In a further aspect there is provided a loudspeaker protection module comprising:

- a main audio signal path between an input for receiving an input audio signal and an output for outputting an output audio signal, the main audio signal path comprising a first band-splitter upstream of a first gain block;

wherein the first band-splitter is configured to split said input audio signal into a plurality of different frequency bands and the first gain block is configured to apply a respective band gain to each said frequency band;

a displacement modeller configured to generate a predicted displacement signal for each frequency band based on the input signal and a model of the loudspeaker; and a gain controller for controlling said band gains to maintain the predicted displacement of the loudspeaker within predefined limits.

In a further aspect there is a loudspeaker protection module comprising:

a main audio signal path between an input for receiving an input audio signal and an output for outputting an output audio signal, the main audio signal path comprising a first band-splitter upstream of a first gain block;

wherein the first band-splitter is configured to split said input audio signal into a plurality of different frequency bands and the first gain block is configured to apply a respective band gain to each said frequency band;

a displacement modeller configured to generate a predicted displacement signal based on the input signal and a model of the loudspeaker;

a second band-splitter configured to split said displacement signal into a plurality of displacement signals for different frequency bands corresponding to the frequency bands of said plurality of audio signals; and a gain controller for controlling said band gains based on said plurality of displacement signals to maintain the predicted displacement of the loudspeaker within predefined limits.

A further aspect provides a loudspeaker protection system comprising:

an input for receiving an input audio signal;

an excursion limiter configured to:

monitor an input signal to determine a predicted excursion in each of a plurality of different frequency bands;

derive a band gain for each of said frequency bands; and apply the respective band gain to a component input signal in said frequency band; and an output for outputting said output signal after application of said band gain.

In a further aspect there is provided a loudspeaker protection system comprising:

a first band-splitter configured to receive an input audio signal and split said input audio signal into a plurality of audio signals in different frequency bands;

a first gain block configured to apply a respective band gain to each of said plurality of audio signals in different frequency bands; and a gain controller for controlling said respective gains;

wherein said gain controller is configured to control said band gains based at least one of a modelled cone displacement or a modelled power dissipation for the loudspeaker for said frequency bands.

There is also provided a method of loudspeaker protection comprising:

receiving an input audio signal;

splitting said input audio signal into a plurality of audio signals in different frequency bands; and applying a respective band gain to each of said plurality of audio signals in different frequency bands;

wherein the method comprises controlling said band gains based at least one of a modelled cone displacement or a modelled power dissipation for the loudspeaker for said frequency bands.

Embodiments of the invention will now be described, by way of example only, with reference to the accompanying drawings, of which:

Figure 15A:
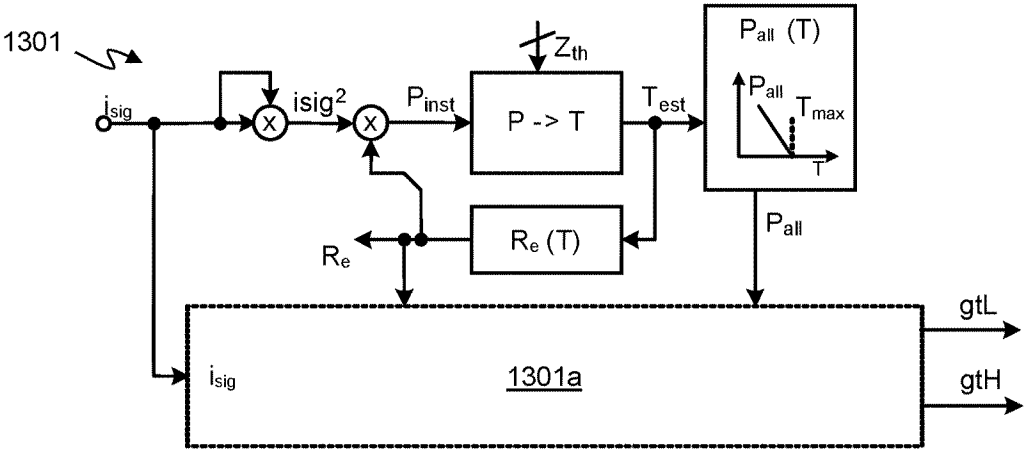
Figure 15B:
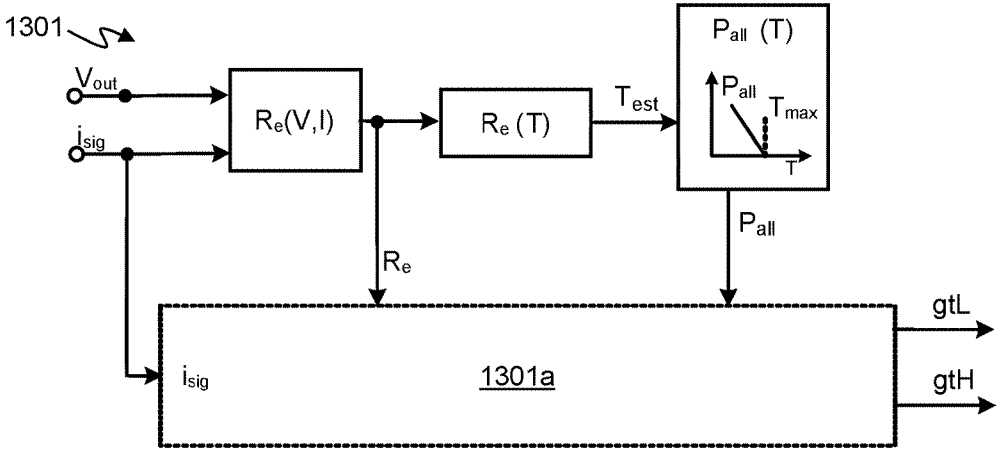
Figure 16:
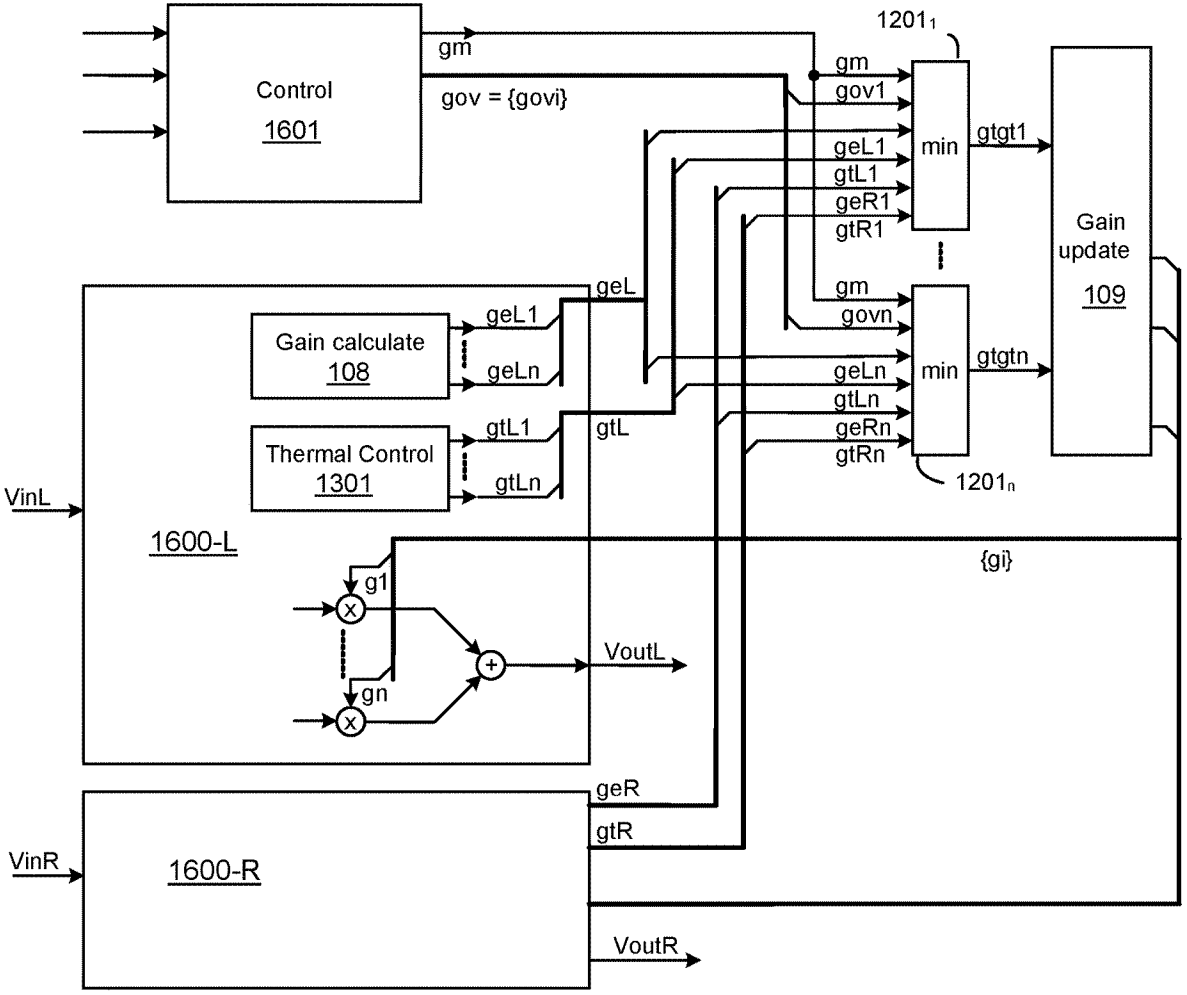

FIGS. 15*a* and 15*b* illustrates examples of thermal protection blocks;

FIG. 16 illustrates an audio system according to an embodiment; and

Figure 17:
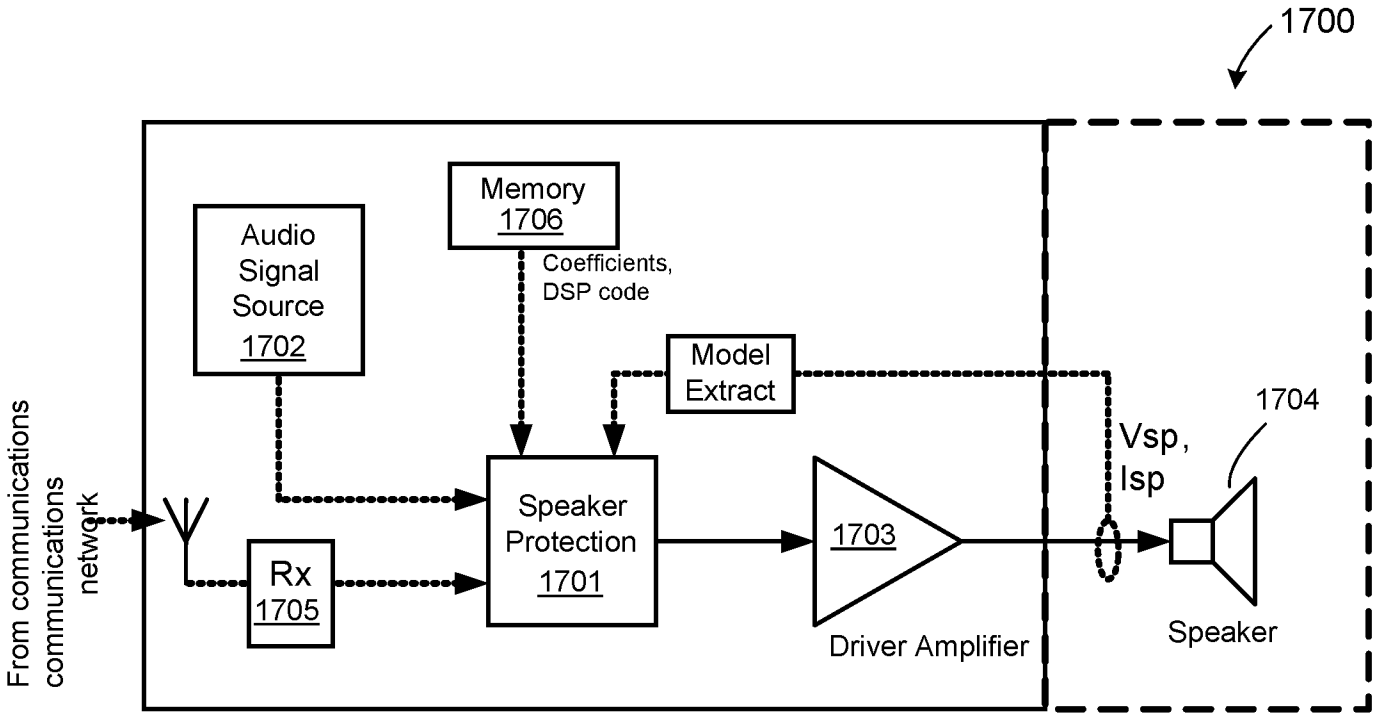

FIG. 17 illustrates an example of an apparatus having a speaker protection system.

DESCRIPTION

As mentioned, it is desirable to provide systems for protecting a loudspeaker from over-excursion, i.e. excessive cone displacement and/or from thermal overload, i.e. excessive temperature.

Figure 1:
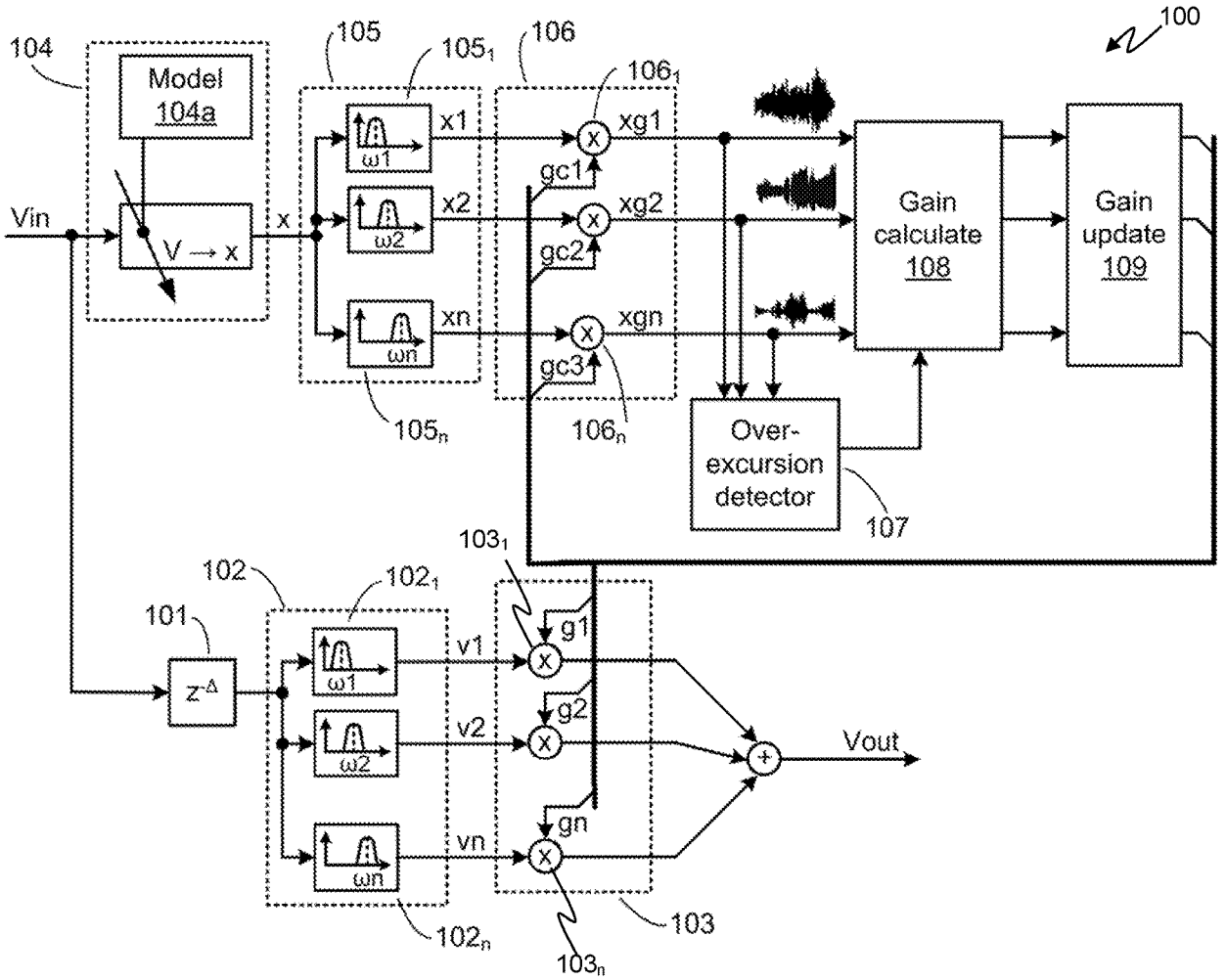
FIG. 1 illustrates a speaker protection block providing excursion limiting according to an embodiment.

FIG. 1 illustrates an embodiment of a speaker protection system or speaker protection block according to an embodiment of the invention. FIG. 1 illustrates a speaker protection block 100 that provides excursion limiting protection for a loudspeaker. Note that as used herein the term 'block' shall be used to refer to a functional unit or module which may be implemented at least partly by dedicated hardware components such as custom defined circuitry and/or at least partly be implemented by one or more software processors or appropriate code running on a suitable general purpose processor or the like. A block may itself comprise other blocks or functional units. Furthermore, note that as used herein the term 'excursion' shall also include and be synonymous with terms such as: "displacement"; "movement"; "travel"; "departure"; "deviation"; "deflection" and the like.

This speaker protection block receives an input audio signal Vin at an input terminal or input node and provides an output signal Vout at an output terminal or output node for forwarding to a loudspeaker, e.g. via a driver amplifier.

In a main signal path the input audio signal Vin passes through a delay block 101 and thence through a frequency band-splitter 102, which may for example be a bank of bandpass filters $\mathbf{102}_1$ to $\mathbf{102}_n$ (or some other functionally equivalent block), that splits the signal into respective waveforms in a plurality of different frequency bands, $fb_1$-$fb_n$. In other words the band-splitter 102, e.g. filter bank, splits the input audio signal into a set of parallel signals each representing the frequency components of the input signal falling within a respective frequency band. The output of each filter $\mathbf{102}_1$ to $\mathbf{102}_n$ of the bank of n filters passes to a first gain block 103, having a plurality of gain elements $\mathbf{103}_1$-$\mathbf{103}_n$, where a respective band gain g1, g2 . . . gn is applied for each frequency band, i.e. a respective gain that applies for that particular frequency band. The gained signals, i.e. the signals after the respective gain has been applied, vg1, vg2 . . . vgn are then combined to provide the signal Vout.

In this embodiment the band gains, i.e. the gains g1, g2 . . . gn for each frequency band, are derived from processing independently of the main signal path of the input signal Vin. The input signal Vin is applied to a displacement modelling block 104 which outputs a waveform x representing an estimated or predicted physical displacement of the speaker cone according to an electromechanical mathematical model 104*a*, i.e. plant model, of the loudspeaker to be driven. The waveform x will vary over time based on the input signal Vin and the model. The displacement modelling block thus provides a voltage-to-displacement, i.e. V-to-x, conversion with a predicted displacement.

The displacement signal x is then passed through a secondary band-splitter 105 similar to the one in the main signal path from Vin to Vout, e.g. a similar bank of n filters $\mathbf{105}_1$-$\mathbf{105}_n$, thus providing a set of respective waveforms x1, . . . xn representing the components of the displacement signal falling within each one of a set of n frequency bands. The displacement modelling block 104 and secondary band-splitter 105 thus together can be seen to provide a displacement modeller for the frequency bands which determines a modelled cone displacement for the loudspeaker for each of a plurality of said frequency bands based on the input audio signal and a displacement model.

In this embodiment, each of the filtered displacement signals x1, . . . xn then passes to a respective gain element $\mathbf{106}_1$-$\mathbf{106}_n$ of a secondary gain block 106 where a respective gain gc1, gc2 . . . gcn is applied to provide a respective filtered gained displacement signal xg1, . . . xgn. As will be described below the gains gc1-gcn applied to the excursion signals in each band are, in this embodiment, the same as the respective gains g1-gn applied in the main signal path to the corresponding bands, i.e. the band gains.

An over-excursion detector block 107 may then detect whether the predicted total excursion of the loudspeaker exceeds or is likely to exceed a threshold, based on the individual gained excursion signals xg1, . . . xgn. The predicted total excursion xt may be determined by combining the individual gained excursion signals xg1, . . . xgn. In some embodiments the signals may be combined to determine the total excursion before being passed to the over-excursion detector block 107 or the over-excursion detector block 107 may itself combine the signals and determine the total excursion. In any case if it is determined that the excursion does or may exceed a threshold the over-excursion detector block 107 may activate a gain calculation block 108 to calculate a revised set of gain values gc1, gc2 . . . gcn that would reduce the predicted total excursion xt to a safe value. If however the predicted total excursion xt is within an acceptable limit the existing gain settings may be maintained.

The gains gc1, gc2 . . . gcn calculated by the gain calculation block may be applied to respective outputs of filters of the filter bank directly, in which case any change in an individual gain may be applied substantially instantaneously. However in some embodiments the calculated gains may preferably be subjected to an attack and release conditioning in gain update block 109. For instance a fast attack time constant for any gain reduction may be applied to ensure rapid attenuation of any sudden increase in signal level but a long release, i.e. decay, time constant may be applied to give a slower increase in applied gain so as to avoid too frequent a change in gain. The conditioning applied by gain update block 109 may include a time delay before any increase in gain instead of and/or in conjunction with the release time. A time delay before a reduction in gain may not be used in some embodiments but in some embodiments a time delay before a decrease in gain may be used for synchronisation.

Since the gains g1, g2 . . . gn applied to the outputs of filters $\mathbf{102}_1$ to $\mathbf{102}_n$ of the filter bank 102 of the main signal path are the same as the gains applied to the outputs of corresponding filters $\mathbf{105}_1$ to $\mathbf{105}_n$ of the secondary filter bank or band-splitter 105, the relative weightings of the audio signal components will be the same as those applied to respective components of the predicted displacement. Therefore when these audio signal components are applied to the loudspeaker they will provide respective components of cone excursion corresponding to the respective components of the predicted displacement, and thus also give a total displacement in agreement with the predicted displacement.

It will be appreciated that there may be a slight inaccuracy due to the time lag between when the signals are applied to the two filter banks, however any such inaccuracy will be relatively small compared to the mechanical time constants associated with the speaker.

Thus the actual excursion of the loudspeaker, i.e. the cone excursion, will be limited in accordance with the predicted excursion. By determining the component of excursion for each of a plurality of frequency bands and applying any necessary gain reduction accordingly, the gain reductions applied may be primarily in those frequency bands providing the largest components of displacement, thus requiring relatively little attenuation of signals in other frequency bands, while at the same time advantageously preserving more audio information and loudness compared to prior schemes involving blanket gain reduction or arbitrary reduction of all low frequency components by some high-pass filter.

Although the signals referred to with respect to FIG. 1 are referred to as waveforms above, these signals may be streams of digital samples at some suitable sample rate say 48 ks/s. The digital samples may be of some suitable resolution as required to give suitable dynamic range in terms of maximum range and quantization noise. The signal samples may be processed in frames, for example of 16 samples per frame.

While each filtered signal waveform contains energy only in the respective frequency band, these waveforms are still time-domain waveforms and not frequency-domain spectral measures.

There are several possible implementation techniques for the bands-splitters 102 and 105, e.g. the filter banks. For example Linkwitz-Riley filters may be employed. Alternatively a frequency-domain approach to filtering could be implemented which may include overlap-and-add based methods, polyphase FIR filters combined with an inverse FFT, FFT/IFFT, and so forth as well known to those skilled in the art.

In some embodiments the secondary the filter bank, e.g. band-splitter 105, may include processing other than conventional linear filtering to provide signals indicative of the band-split components of the predicted displacement of the cone. For example after band-pass filtering the signal may be rectified. In such an embodiment the sum of these rectified values will provide an apparently conservative estimate of the total excursion ignoring any cancellation of components of different polarity. However the components in different frequency bands are likely to be uncorrelated for most types of source audio material, so even if the components cancel at one point in time they are likely to reinforce at a point in time soon after, so this conservative estimate may reduce the gain modulation, and even be subjectively better if the components "beat" with each other.

Similarly peak detection with some attack and release characteristics may be applied to the predicted excursion signals in the various frequency bands to reduce the point-by-point or frame-by-frame variation in the reported excursion estimate x1-xn. If the signal is processed in frames, the maximum value for each frame may be used as the indicative signal x1-xn. Advantageously there is then for each frequency band only one sample per frame which needs to be multiplied by the gain elements.

However in some embodiments the indicative excursion signal comprises a stream of samples simply representing the predicted excursion components in each frequency band as respective time-domain waveforms, with further processing within the gain calculate block 108.

As mentioned above the band-specific excursion estimates xg1, . . . xgn may be supplied to an over-excursion detector 107 and combined to provide an estimate for the total excursion xt. The combining may involve simple summation, or it may comprise other operations such as peak detection rectification and maximum detection similar to that disclosed above. If the estimated total excursion xt exceeds some threshold then the gain calculate block 108 is activated to provide updated gains. In this embodiment it will be appreciated that the overall excursion estimate xt is thus based on excursion estimates already taking into account the gains to be applied to the audio signal. Therefore a gain calculation may also be necessary in order to let the gains increase as a result of generally decreasing audio signal level. In other words if a particular gain has previously been reduced for a given frequency band to prevent over-excursion but the audio signal in that band has subsequently decreased the previously applied gain correction may no longer be needed. The calculation may therefore need to determine whether a previously applied reduction to a gain need be maintained.

In other embodiments disclosed below the gains applied to the excursion signals may not account for the actual gain applied to the audio signal in the main signal path. In such embodiments the over-excursion detector 107 may detect that even were no audio signal attenuation to be applied the predicted excursion would still be below the predetermined threshold, and thus allow the gains applied to relax back slowly to nominal values without detailed calculation.

As mentioned above in some embodiments the highest combined excursion, calculated, for example, by the over-excursion detector 107 or in a similar fashion, in each frame of excursion data is deduced and the set of samples xg1, . . . xgn corresponding to that same time point is used for the gain control calculations. This is more economical than calculating separately for every time point.

Several different methods may be used to set the gains of each band to reduce excursion to below the threshold.

In some embodiments iterative error minimisation techniques may be used to iteratively adjust the set of gain values {gi} so that the weighted sum Σgi·xgi converges to an excursion threshold value xmax. For example a simple Normalized Least Mean Squares (NLMS) optimisation may be used with some fixed convergence factor μ so that for each iteration gi is calculated as:

$$gi+\mu(x\ \max-\Sigma gi{\cdot}xgi)xgi=gi+\mu e\ xgi.$$

Alternatively the convergence factor may be different for each frequency band, based on say the rms value of xgi in the frame relative to the total of these rms values to accelerate convergence of the strongest contributors. However these iterative methods, while providing a solution for the gains that satisfies the maximum excursion limit, do not necessarily provide the set of gain values that maximises the loudness of the composite signal.

In some embodiments, a linear programming technique, e.g. a SIMPLEX algorithm may be used. For example the main constraint may be to maximise the sum of the gains Σgi subject to Σgi·xgi remaining less than xmax. In some embodiments the objective may be to maximise a weighted sum of the gains, i.e. to maximise Σwi·gi subject to Σgi·xgi remaining less than xmax, where {wi} are a set of weights per frequency band, for example to allow bass to be emphasised or to emphasise frequency bands which contribute more to psycho-acoustically perceived loudness.

To avoid over-frequent modulation of the gain applied to the audio signal, the gain calculated by the above method or otherwise in block 108 may be subjected to some sort of time domain control such as attack and decay time constants or timeouts or by imposing a maximum gain step per frame, illustrated by separate block 109, though in some embodiments some aspects of the calculations may be combined for efficiency of computational effort.

The resulting gain values g1, . . . gn are then applied to the respective audio signal band-split components audio signal by gain block 103, and the gained components are summed to provide a signal Vout to be applied via some driver amplifier to a loudspeaker. The resulting excursion of the actual speaker cone is thus limited to a value corresponding to the threshold xmax set in the gain control block.

The delay block 101 allows time for the processing of the predicted excursion based on the current gain settings for each band and calculation of any required gain changes before the relevant part of the audio input signal reaches the gain block 103 of the main signal path. Thus the delay block 101 provides time for any necessary gain changes to be implemented before the relevant part of the audio signal is subject to the gain.

In some embodiments however the delay block 101 may be omitted. In such a case the gains applied to a sample or to a frame of the input signal will no longer be time-aligned to the gains applied to provide the excursion estimate but in some applications the resulting possible over-excursion may be small enough to be permissible if not too frequent.

In some applications the speaker protection may be applied to an audio signal where some dynamic range control may be applied.

Figure 2:
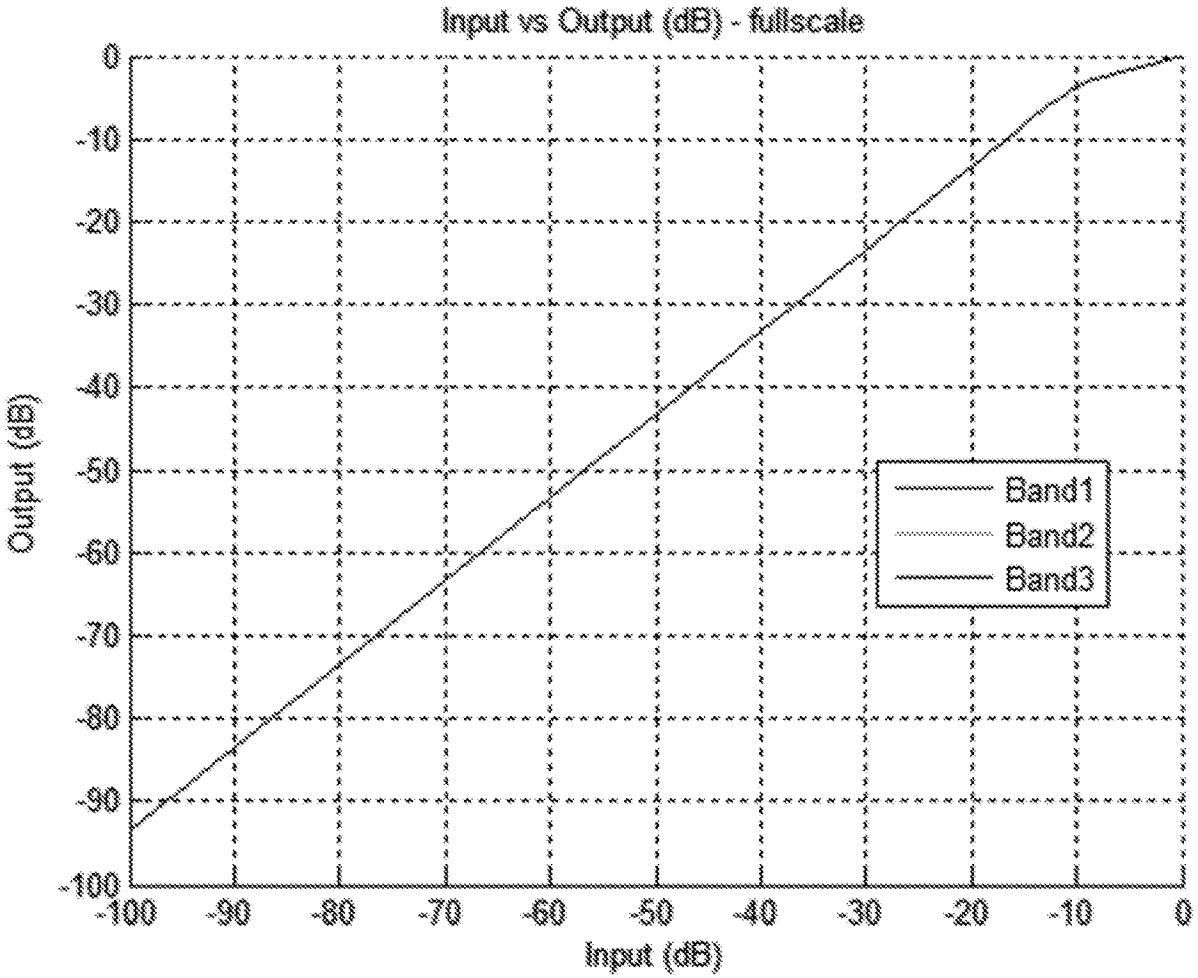
FIG. 2 illustrates a transfer function that may be applied for dynamic range compression.

For many applications it may be desired to increase the loudness of quiet parts of programme material yet not overload on loud parts, without introducing objectionable audio artifacts. Thus for example audio signals with a peak or rms sound level more than say 12 dB below some reference maximum signal level may be boosted by say 6 dB, while this gain boost is smoothly decreased for signals above this level to give 0 dB boost at the 0 dB signal level, as illustrated in FIG. 2. FIG. 2 illustrates one example of a possible transfer function of input versus output level. The gain applied to the audio signal for this purpose may be adjusted based on the input signal, with the input signal level being estimated by some peak detector with attack and decay time constants or time delay, and with the gain adjust also being subject to attack and release time constants or time delays.

This function may be performed separately on each of a set of frequency bands, providing a function known as Multi-Band Compression (MBC). This avoids unnecessary attenuation of signals in those frequency bands that do not contain a lot of energy at the time while allowing adequate attenuation in those frequency bands that are using up the total signal swing available.

In some embodiments MBC may be applied to the signal before the speaker protection block. In other words the signal Vin discussed above could be a signal to which some sort of dynamic range compression, such as MBC, has been applied. However keeping the MBC and Speaker Protection as two independent blocks can create potential problems. For example, the gain adjustment time constants for MBC may provide signal level modulation that interacts with the gain adjustment in the speaker protection block. Also say the low frequency gain might be boosted in the MBC but then have to be attenuated to reverse this gain boost in the Speaker Protection block. Also the required filtering and gain application may involve significant processing delay and physical power consumption.

In some embodiments therefore the functions of MBC and Speaker Protection may be combined. Such a combination may save signal processing and computation expense.

Figure 3:
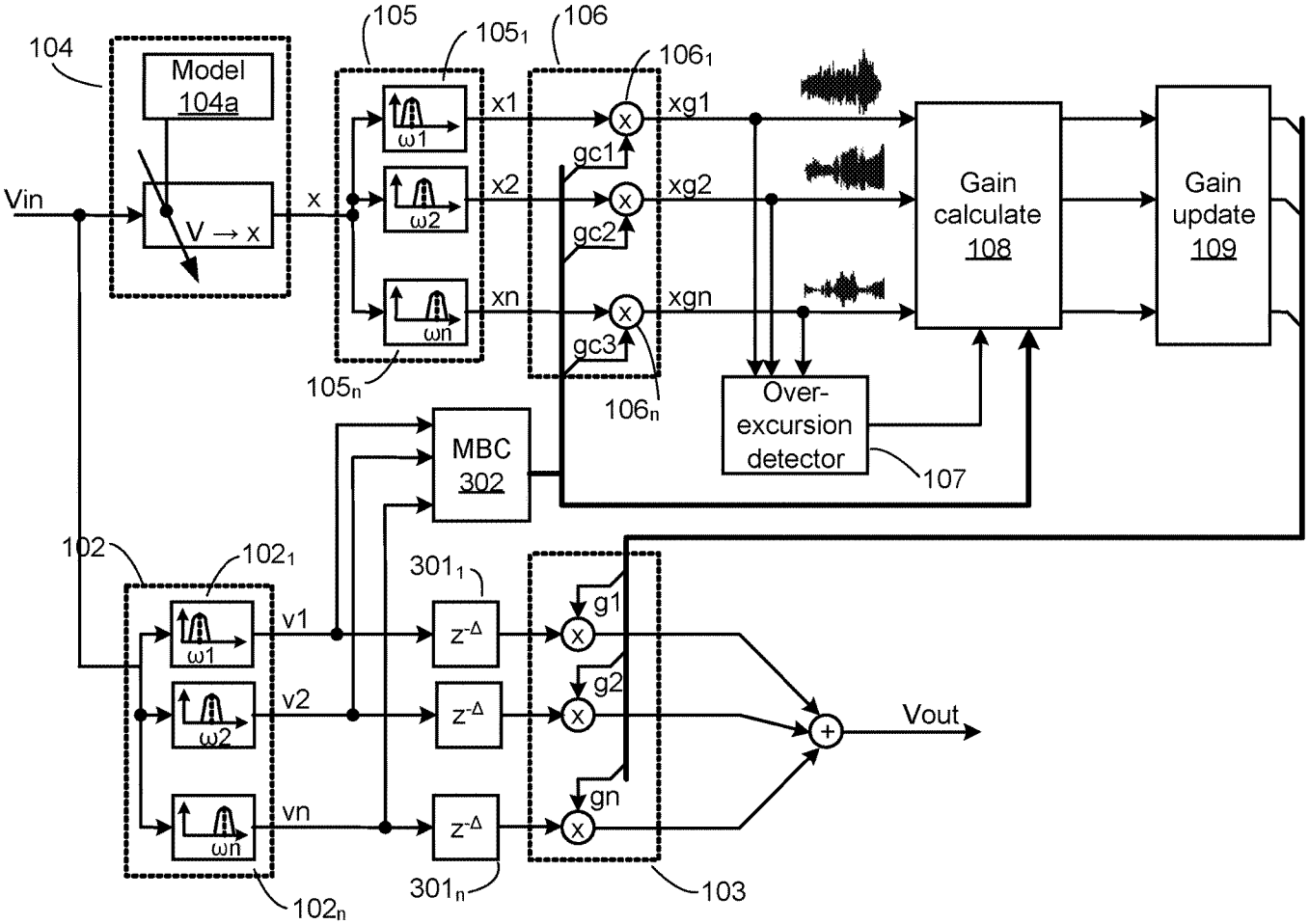
FIG. 3 illustrates an embodiment having speaker protection combined with multi-band compression.

FIG. 3 illustrates another example of a Speaker Protection block for excursion limiting according to an embodiment of the invention.

This speaker protection block comprises many blocks which are the same or similar to respective blocks in FIG. 1 and which are identified using the same reference numerals.

In the embodiment of FIG. 3 the input audio signal is again received and, in a main signal path, split into various frequency bands by band-splitter 102, i.e. a filter bank, with each band having a respective gain applied by gain block 103, before the individual signals are recombined to provide the output signal Vout.

In the embodiment of FIG. 3 however in main, i.e. primary, signal path, the input signal is coupled to the filter bank 102 prior to delaying the signal. The main path signal is still delayed before reaching the gain block 103 but in this embodiment the signal is delayed after it has been split into a plurality of different frequency band signals. Since there are multiple filtered signals v1 . . . vn, each has to be delayed by a separate delay $\mathbf{301}_1$-$\mathbf{301}_n$ block before application of the respective gain.

A dynamic range control block 302, which in this example is a Multi-band dynamic range control block such as a Multiband Compression Block, taps the individual frequency band signals v1-vn produced by the filter bank 102 before they are delayed and operates to provide a desired compression function.

For example the Multiband Compression Block MBC 302 may operate on each of the band-limited input signal components v1 . . . vn to provide a gain boost for low signal levels and not to provide a gain boost for higher signal levels in each band, in a similar fashion to that discussed above.

The input signal Vin is also input to a displacement model 104 and then split into corresponding displacement signals for the frequency band by filter back 105 as discussed above. In this embodiment however the gain blocks $\mathbf{106}_1$-$\mathbf{106}_n$ acting on these band-limited displacement signals have gains, gc1-gcn, defined by the Multiband Compression Block 302.

These gains are thus applied to corresponding displacement signals x1 . . . xn in the secondary path and provide respective estimates representing the components of displacement that would be provided if the input signal were weighted according to gc1 . . . gcn and applied to the loudspeaker. As described above the resulting gained signals xg1 . . . xgn may be combined to provide an indication the total predicted displacement and an over-excursion detector 107 may determine whether this total excursion exceeds or is likely to exceed a specified maximum displacement.

If the total predicted displacement is less than the specified maximum displacement then the gains defined in MBC block 302 may be allowed to propagate unchanged via Gain Calculate block 108 and be applied to the respective gain blocks $\mathbf{103}_1$-$\mathbf{103}_n$ in the main signal path. The signals in the main signal path will thus be modulated in a similar way (disregarding the delays in the signal path and in the gain derivation path) as if the multi-band compression had been applied directly to the signal.

If the total predicted displacement is more than the specified maximum displacement then the gains gc1 . . . gcn may be modified by Gain Calculate block 108 (and possibly also the attack and decay dynamics instituted by Gain Update block 109) in a similar way to that described previously, except allowance must be made for the total excursion being predicted on the basis of signals xg1 . . . xgn not subjected to the speaker protection gain modulation, i.e. a feedforward gain adjustment algorithm rather than a feedback gain adjustment algorithm.

Figure 4:
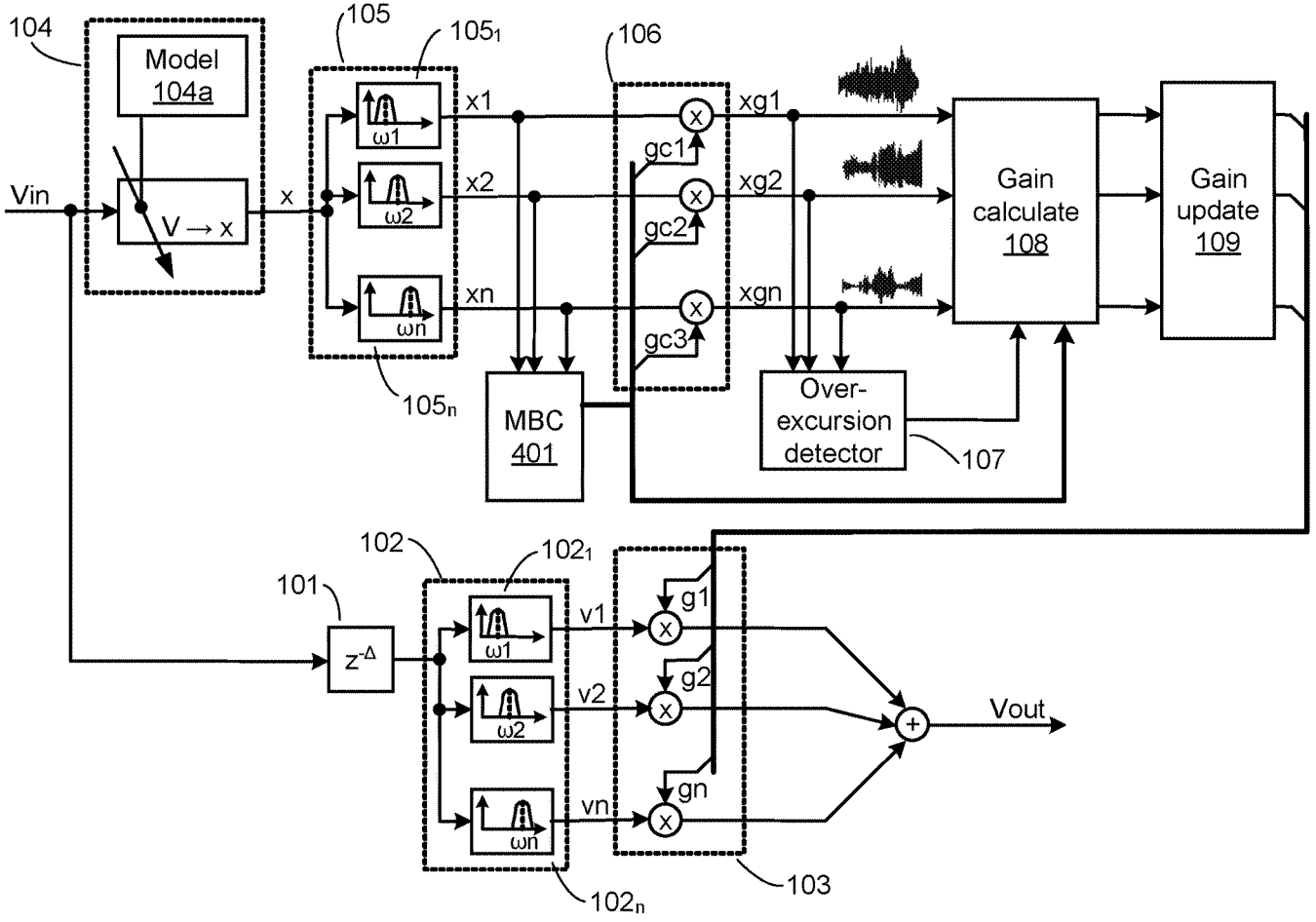
FIG. 4 illustrates an alternative embodiment having speaker protection combined with multi-band compression.

FIG. 4 illustrates a further embodiment of a speaker protection block for excursion limiting. This is again similar to FIG. 1 with similar elements being accorded the same numeric labels and similar signals being accorded the same names.

As in FIG. 3, the gains applied in the displacement domain, i.e. to the signals of predicted displacement in the various frequency bands, are different to those applied in the main signal path, but in the embodiment illustrated in FIG. 4 the multi-band compression is performed with respect to the displacement domain filtered signals x1 . . . xn rather than the audio signal filtered signals v1 . . . vn. Thus in the embodiment of FIG. 4 the input signal Vin is input to the displacement model 104 and the resultant displacement signal x(t) input to filter bank 105 in a similar fashion as discussed above. In this embodiment however a multi-band compression block 401 is provided to operate on the band limited displacement signals x1 . . . xn.

The embodiment illustrated in FIG. 4 avoids the need for multiple parallel delay lines in the main signal path. However since the dynamic multi-band compression is based on the physical excursion, the definition of the compression parameters has to take account of the nominal physical speaker model, and may be different from legacy implementations with the compression preceding the speaker protection, and indeed be different according to what model of speaker is attached.

The system illustrated in FIG. 4 may however be more efficient in terms of excursion utilisation. In this scheme, compression curves may be expressed in terms of "excursion_in" in and "excursion_out" for each of the n frequency bands. The lower frequency bands (which may contribute more to excursion), may have less makeup gain and an earlier knee with a higher compression factor to reduce over-excursion. Higher-frequency bands may have looser compression curves to maximise loudness as they don't contribute significantly to overall excursion.

Figure 5:
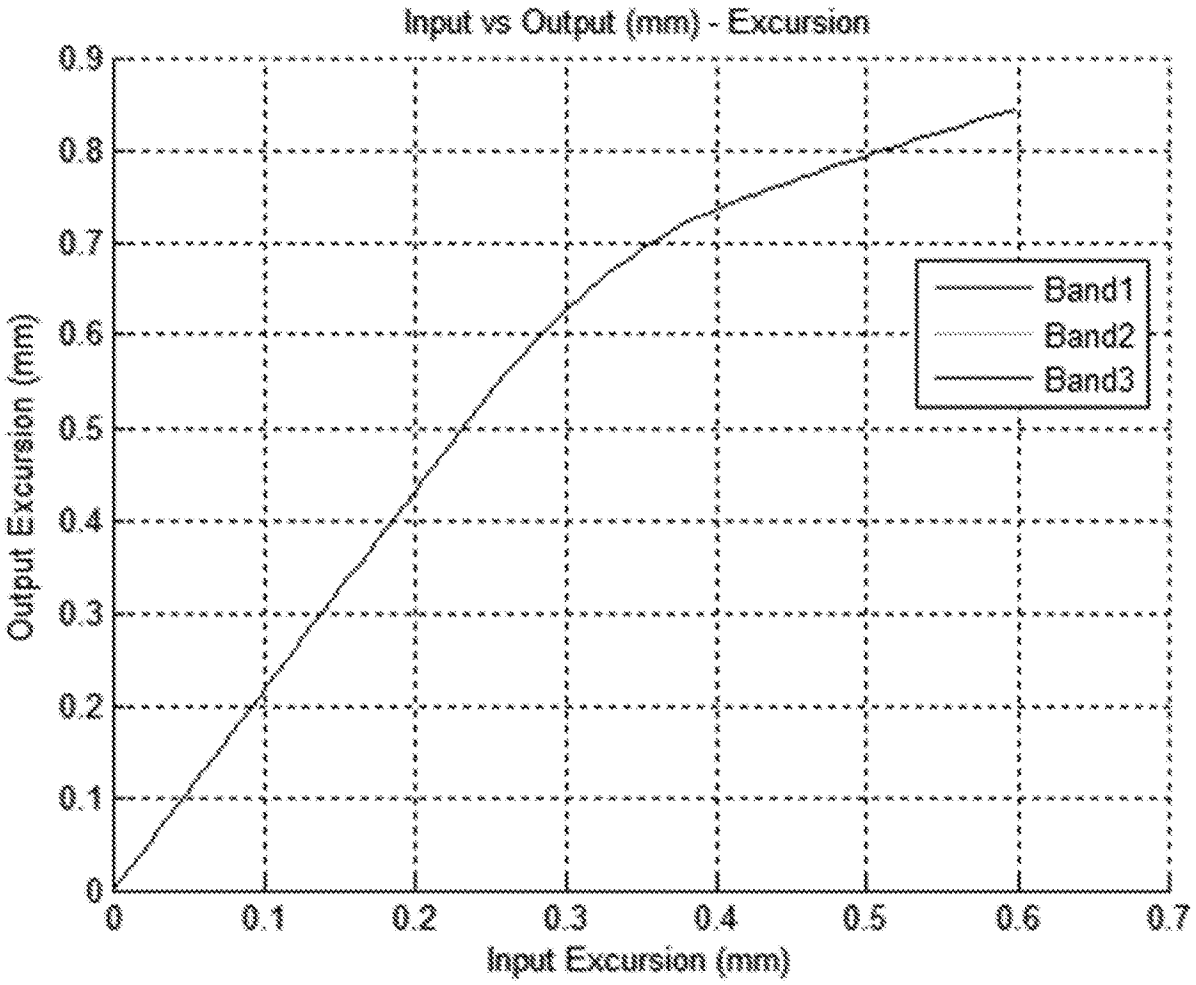
FIG. 5 illustrates a transfer function that may be applied for dynamic range compression in embodiments such as illustrated in FIG. 4.

As in this embodiment the compression is being applied to an excursion signal the compression response curve, i.e. the transfer function applied by the MBC block 401, is defined in terms of input excursion to output excursion. FIG. 5 shows a compression response curve having the same general response as that illustrated in FIG. 2, but expressed in excursion values. FIG. 5 thus shows one example of a possible suitable response curve having a characteristic where signals up to half of the maximum physical excursion (which is 0.6 mm in this example) are boosted by a factor of 2 (i.e. 6 dB), with this gain boost dropping to effectively unity gain at a the maximum (e.g. 0.6 mm) physical excursion. This shows that, if a designer were to use the same compression curve as the one defined in the "voltage domain" there may be excursion issues because he might specify a boost at low frequencies without considering the impact on excursion. If the compression curves are defined directly in the "displacement domain" the effect of compression on excursion becomes immediately apparent and advantageously eases optimisation of the compression tuning for the system.

Figure 6:
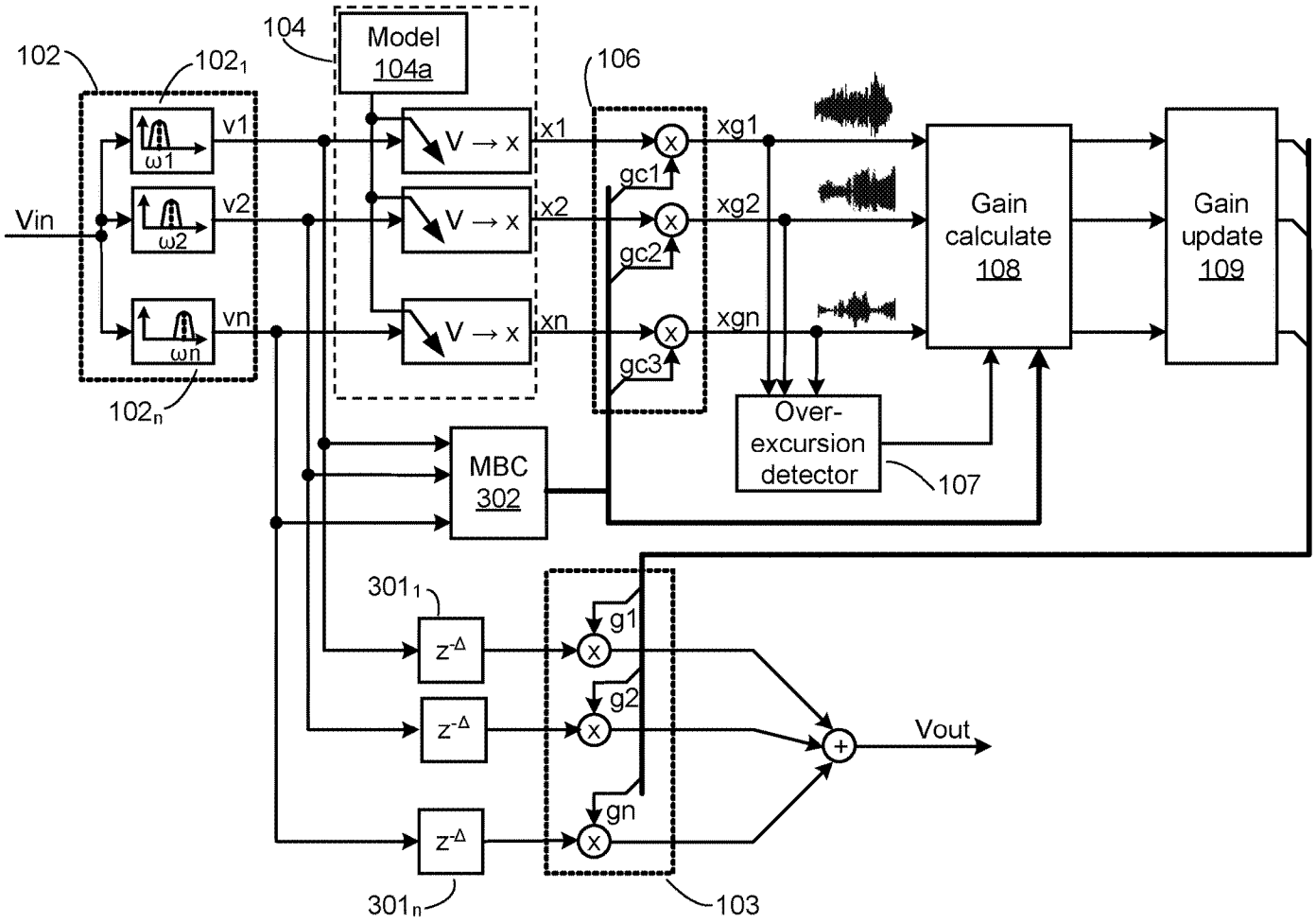
FIG. 6 illustrates a further embodiment of a speaker protection block.

In the examples discussed above the input signal is input to a displacement model and then band-split so that the excursion in each of a plurality of different frequency bands can be determined. As discussed above this allows any necessary gain adjustment for excursion limiting to be applied just to the necessary frequency bands. The audio signal in the main signal path is thus accordingly also band-split to allow band specific gains to be applied. In some embodiments however, as illustrated in FIG. 6, rather than separate filter banks for the excursion and the audio signal processing, a single filter bank 102 may be provided at the input to filter the input signal into audio signals, e.g. voltage signals, in the various frequency bands. In this embodiment the displacement calculation or modelling block 104 thus receives separate signals for each of the n frequency bands and then calculates the excursion components separately for each frequency range. This may give savings in computation and give adequate performance though would be inaccurate in the presence of any substantial non-linearities in the displacement model 104*a*. The delay in the main signal path is thus applied after the band-splitting, in a similar manner to the example illustrated in FIG. 3.

In some embodiments at least some of parameters of the speaker protection block may be configurable differently according to a user's use case. For example a longer signal delay may be permissible in music play-back use, with potentially high-quality source material, allowing less aggressive attack times for the gain modulation and less consequent manipulation of the original signal. On the other hand, for phone voice calls for example the delay may preferably be reduced to meet a lower latency budget. The parameters may therefore be configurable. In some embodiments the parameters may be configurable in use, for instance a user could select certain parameters according to the their preference and/or defined sets of parameters could be selected based on the use, for instance an applications processor, or the like, could determine whether a media file is being played or whether voice call data is being relayed.

The coefficients of the displacement model, for example a Thiele-Small Model, may be fixed, maybe by initial design on the basis of some initial characterisation from pilot builds, or by a one-time calibration during manufacturing. The coefficients may be adapted during use on the basis of parameter estimates from the voltage and current waveforms in the load, and possibly modified in use based on a detection of temperature of the voice coil or some other part of the speaker or host device or of the ambient temperature.

The centre frequencies or the pass-band widths or corner frequencies of at least some of the n filters in each filter bank may be linearly spaced with respect to one another. This may provide finer control in lower octaves of frequency where amplitude tends to be high and excursion issues are more likely to occur. Additionally or alternatively at least some of the bands may be logarithmically, i.e. non-linearly, spaced with respect to one another, i.e. in octaves or one-third-octave or suchlike to provide coverage of the whole frequency spectrum economically. The bandwidth of each of the n filters may largely be defined by the spacing between the adjacent centre frequencies, as the whole frequency band should preferably be covered without gaps or substantial overlaps so that the composite signal may be recovered by a simple addition of the signals.

The centre frequencies or pass-band widths or corner frequencies may be fixed by initial design or may be adjustable in use. They may be adapted in use, on the basis of changes detected by the adaptation of the parameters of the displacement model for example.

Figure 7:
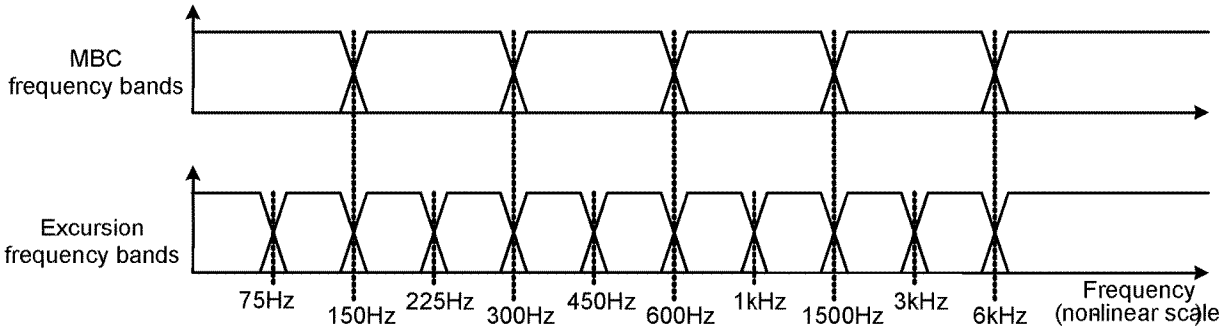
FIG. 7 illustrates one example of frequency bands for excursion limiting and for multi-band compression.

FIG. 7 illustrates one example of the distribution of frequency bands in an embodiment. The lower trace illustrates the frequency bands used for excursion limiting, for example as implemented by the filter bank 102 of FIG. 6. In this example, the frequency bands are equally spaced for lower frequencies, but the cut-off frequencies become octaves above 1.5 kHz.

The upper trace of FIG. 7 illustrates that the Multi-Band Compression block 302 may process signals in fewer frequency bands than the excursion limiting, with a consequent reduction in requirement for signal processing effort or hardware.

Rather than implementing a separate sets of filters for the excursion and MBC processing, the frequency bands for MBC processing may effectively be realised by just combining the outputs of the two lowest-frequency filters in the common filter bank 102.

Figure 8:
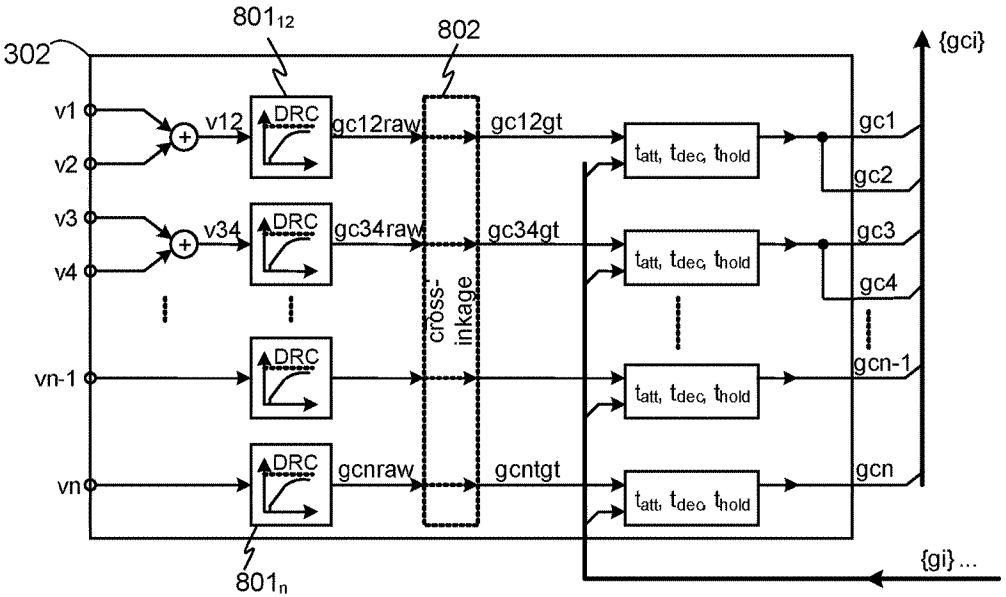
FIG. 8 illustrates a multi-band compression block that combines frequency bands.

FIG. 8 illustrates a Multi-Band Compressor 302 where at least some pairs of input signals, for example v1 and v2, are combined for this purpose, i.e. so as to provide a combined frequency band of greater frequency range. The combined signal v12 derived from v1 and v2 is then input to a dynamic range controller $\mathbf{801}_{12}$ which outputs the gain gc12raw necessary to increase or decrease the signal to give the required signal-dependent gain boost or attenuation. This gain g12raw may be subject to further dynamic processing to control the dynamics of the gain signals {gci}, for example and attack time $t_{att}$, a decay time $t_{dec}$ or a hold time $t_{hold}$ before the gain gc1 is output for use in multiplier bank 106 of FIG. 6. The same gain may be output to supply gain component gc2. It will of course be appreciated that more than two frequency bands used for excursion limiting could be combined to create a combined frequency band for MBC processing. It will also be understood that the MBC processing may be performed on a mix of some combined frequency bands corresponding to multiple excursion frequency bands and some frequency bands corresponding to a single excursion frequency band. It will also be appreciated that a similar approach could be adopted for a Multi-Band Compressor that acts on the displacement signals, such as illustrated in FIG. 4, i.e. the inputs v1 to vn could be displacement signals (x1 to xn).

In some embodiments the gain values $\{g_i\}$ from the Gain Update block 109 of FIG. 6, or control information derived from the processing in the block 109 may also be received by Multi-Band Compressor 302 and used to override or alter the dynamic control of the gain signals {gci} to prevent any undesirable interaction between the dynamics that would otherwise be imposed within the Multi-Band Compressor and those imposed on the gain by the dynamic processing in Gain Update block 109.

In some embodiment the gain calculation, in the Multi-Band Compressor 302 or in the Excursion Control gain calculation block 108, rather than being totally independent for each band, may incorporate some cross-linkage or defined relationship between the modulation in the various between frequency bands so as to avoid any artificial effects due to suppressing all the energy in one band rather than a more balanced gain reduction. The gain modulation may take account of psychoacoustic effects and/or attempt to incorporate some boosting of bass where possible in terms of excursion and where desired. Such interlinkage is illustrated in FIG. 8 by the cross-linkage block 802 which maps the gain values {gc12raw . . . gcnraw} to modified gain values {gc12tgt . . . gcntgt}.

Figure 9:
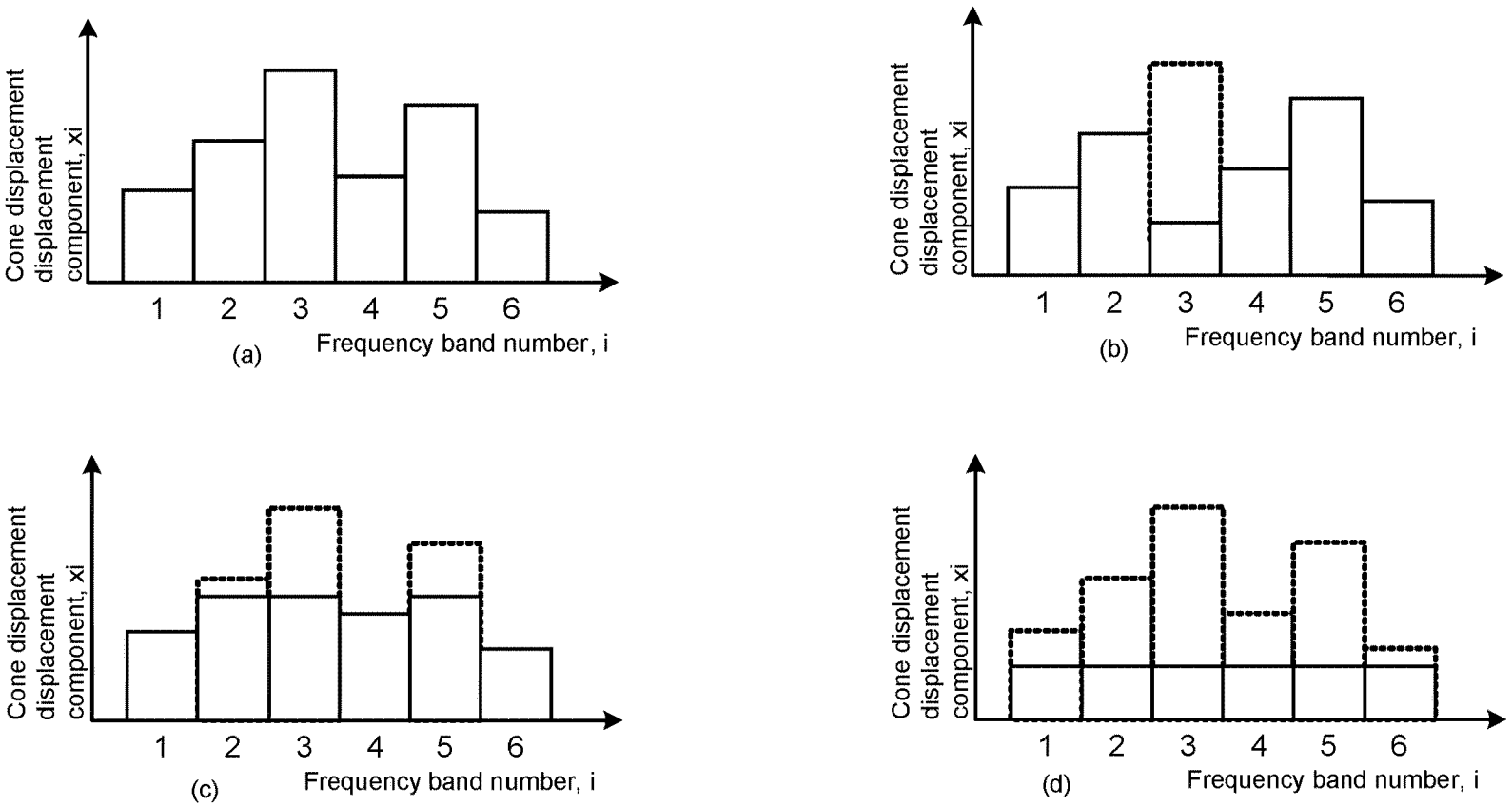
FIG. 9 illustrates examples of how attenuation of frequency bands may be applied in one embodiment.

FIG. 9 illustrates a simple method for interlinking the gain adjustments in frequency bands in order to reduce the maximum attenuation applied across the frequency bands in the case of the Excursion Control Gain Calculation block 108 of FIG. 6 for example. FIG. 9(*a*) shows the per-frequency-band cone displacement components before gain adjustment. The total predicted excursion is the sum of the displacement components, and may be represented in terms of the total area within the rectangles shown. (In this case the frequency bands are shown as equal, but the method could be adapted for the case of unequal frequency bands). A simple algorithm would attempt to reduce the total excursion by identifying the frequency band with the largest displacement component and attenuating the signals just in this frequency band, band number 3 in this illustration, as illustrated in FIG. 9(*b*). However this would greatly attenuate output audio signal components in this one band while leaving others attenuated, and thus give a "hole" in the playback frequency response of the system.

An alternative is therefore to effectively to progressively determine the attenuation across all of the frequency bands. For example the once the excursion component of band 3 has been attenuated so as to be equal to or below that of the next largest band, band 4 in this example, the signal in band 4 is also attenuated, and once the equal excursions in these two bands have been attenuated to equal or below that of the next highest excursion, band 5 in this example, all three bands are attenuated as illustrated in FIG. 9(*c*). In this way the overall attenuation in band 3 is reduced, at the expense of some attenuation in other bands.

In practise, this technique of attenuating only the most significant bands may be used until a defined number or proportion of frequency bands, say four bands, are involved. Further excursion reduction may then be applied to all bands as illustrated in FIG. 9(*d*). Similar techniques may be employed in determining gain within the Multi-Band Compressor block 302.

In general therefore this example of controlling the band gains effectively identifies a threshold value for the predicted cone excursion component of an individual frequency band and controls the band gains to reduce, down to the threshold value, the cone excursion components for those frequency bands that would otherwise exceed the threshold.

In some embodiments excursion limiting may be not performed on some frequency bands of the input signal. For instance the output of the highest-frequency filter 102*n* in FIG. 6 may be routed directly to the output adder providing Vout. Due to the mechanical inertia of the anticipated speaker load, it may be judged that the contribution to cone displacement is likely to be negligible compared to the other components.

Figure 10:
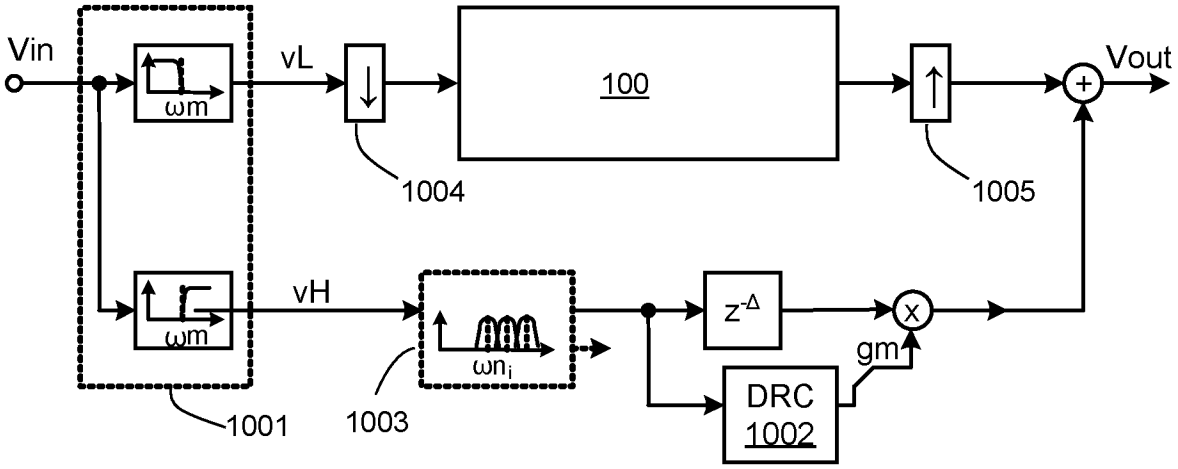
FIG. 10 illustrates an embodiment where a speaker protection block is arranged to apply excursion limiting to only some frequency components.

It may still be desired however to apply Dynamic Range Compression to signals in this highest frequency band. FIG. 10 illustrates an embodiment where the input signal Vin passes through a path splitter comprising a band-splitter 1001 in which Vin is low-pass and high-pass filtered at a corner frequency of wωm. Signal components below frequency ωm are processed substantially similarly to the previous embodiments by speaker protection block 100. Signal components above frequency ωm are subject to dynamic range control similar to the processing described previously by DRC block 1002, with the calculated desired gain then being applied to these high frequency signal components before the resultant gained signal components are recombined with the lower-frequency components.

In some embodiments the signals of frequency greater than ωm are processed in a single frequency band. In other embodiments these high-frequency signals may be split into sub-bands by filter bank 1003 and processed for Dynamic Range Compression individually at least to some extent before being recombined with the lower-frequency signals.

In some embodiments the signal components below ωm may be down-sampled by downsampler 1004 before excursion-limiting processing. For example ωm may be 6 kHz and Vin sample rate may be 48 ks/s. Signal components may then be down-sampled to a sample rate of say 12 ks/s or 16 ks/s. A higher sample rate is unnecessary for these low-frequency signals, and this saves on computational effort and power or hardware. The excursion limited signals may subsequently be upsampled by upsampler 1005 before being combined with the high-frequency components.

As mentioned, it is also desirable to protect the speaker from over-temperature, but desirable to reduce the number or extent of processing steps applied to the actual audio signal.

Figure 11:
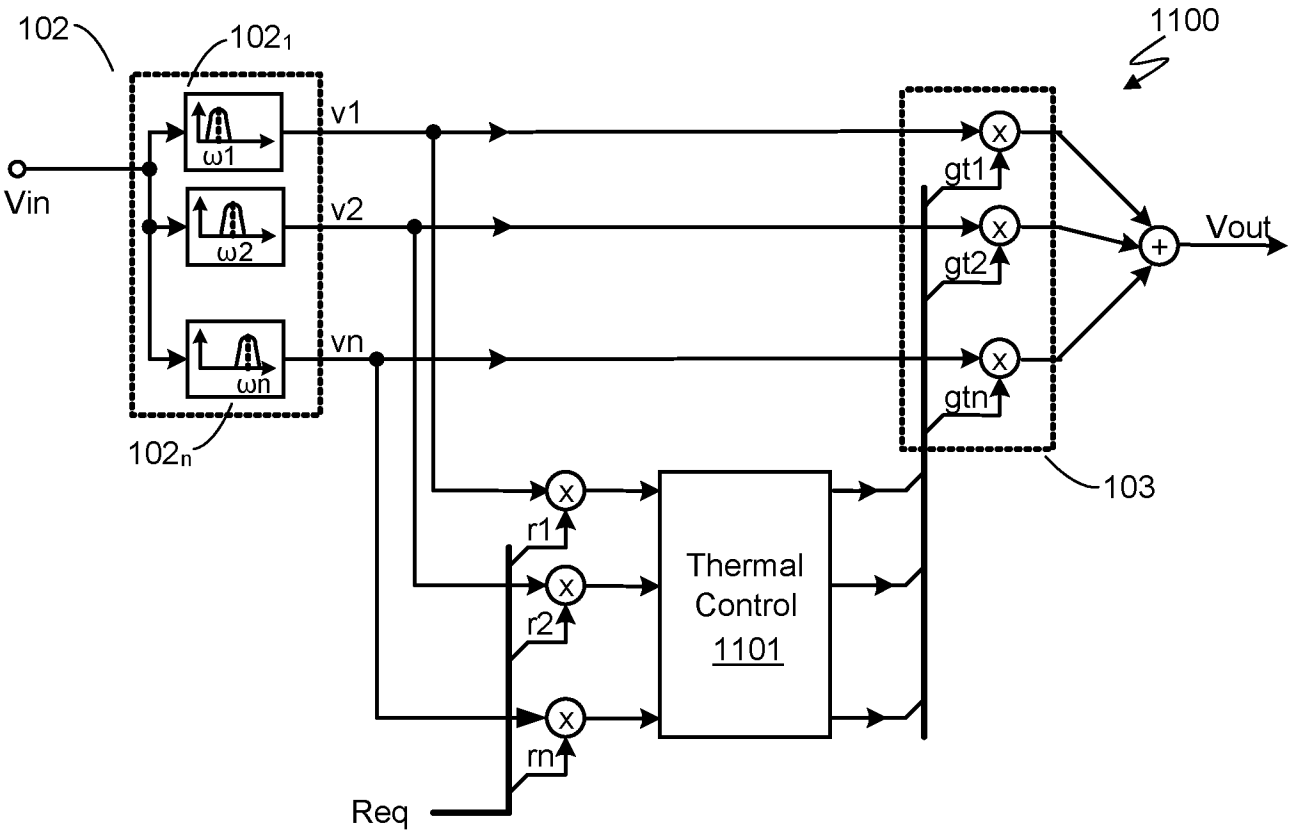
FIG. 11 illustrates a speaker protection block providing thermal protection according to an embodiment.

FIG. 11 illustrates an example of a Thermal Protection block 1100. The Thermal Protection block receives an input audio signal Vin and provides an output signal Vout.

This example uses band-splitters to split the input signal into frequency bands to allow for gain corrections to be applied just to those frequency bands where correction is required, in a similar fashion to the excursion limiting discussed above. The thermal protection block thus comprises at least some components which are similar to those of the embodiments described previously and which will be identified by similar reference numerals.

In a main signal path, the signal input to the Thermal Protection block, Vin, is split into n frequency bands by a first frequency band-splitter 102, e.g. a filter bank, which may be a filter bank such as described previously. The various band-limited signals v1-vn in the main signal path are input to a gain block 103 which applies respective gains gt1-gtn to the various band-limited signals before the signals are recombined to provide the output Vout.

To provide thermal limiting the respective contribution to power dissipation arising from signals in each of the n signal frequency bands is calculated separately for each signal frequency band. The separate calculated power dissipation for each of the signal frequency bands is then used as inputs to a thermal gain control block 1101 which may provide the set of n signal gains gt1-gtn to be applied to corresponding n frequency bands of the audio signal.

It should be noted that since the thermal time constants are significantly greater than the frame rate of the calculations, the timing constraints associated with thermal protections are not as great as those discussed above in relation to excursion limiting.

Thus the filtered signals produced by the filter bank 102 in the main signal path can be used to determine the gain settings to be applied for thermal limiting without the need to delay the audio signal to allow ongoing calculation of the revised gain. This removes the need for a separate filter bank for thermal protection calculation and also means that the thermal protection block does not add any significant signal delays.

The calculation of the respective power dissipated may use a value for the average coil impedance in each frequency band. Thus as illustrated in FIG. 11 the voltage signal for each band may be multiplied by a value, r1-rn, based on the impedance in each frequency band to derive a signal indicative of the power dissipation in each band. For example r1 may be set to $1/\sqrt{(Re1)}$ where Re1 is an appropriate equivalent resistance for frequency band 1. This will provide a value equal to $v1/\sqrt{(Re1)}$, which when squared provides $v1^2/Re$, an estimate for the thermal power dissipation directly due to the signal in frequency band 1. Thermal power dissipation may be calculated similarly for the other bands.

In some embodiments the calculation for at least some of the n frequency bands may use a pre-defined or pre-characterised or pre-calibrated value for the average coil impedance in each frequency band, e.g. a predetermined and stored value. In other embodiments, the impedance value to be used may be generated from an electro-mechanical model whose parameters may be adapted over time in use on the basis of at least one of load voltage, current, coil temperature or ambient temperature.

Note that in some embodiments instead of deriving the power dissipated in the loudspeaker from the input signal in the various frequency bands an estimate of power may instead be determined for the relevant frequency bands based a measured current and/or voltage or an rms level of current and/or voltage measured for the loudspeaker.

The thermal gain control block 1101 uses the power in each band, together with a model for the thermal impedances to predict the actual temperature rise over the ambient temperature, or some other thermal "ground" for example the local chassis or body of a host device. This thermal model may be predefined on the basis of characterisation of pilot builds or initial pre-production samples or may be calibrated during manufacture or may be modified partly or wholly in use as parameters extracted from the ongoing adaptation of the electro-mechanical model.

Since the thermal time constants are relatively long, a common thermal impedance model may be used for all the bands, and a common coil temperature estimate may be extracted from the overall power dissipation and the thermal impedances to a thermal reference point or thermal "ground", together with an estimate of the temperature of the thermal "ground" to which the thermal impedances are referred, for example the temperature of the ambient environment or the temperature of a certain location on the chassis or body of the host device.

Based on the model and the predicted temperature rise the thermal gain control block 1101 may determine whether the temperature is exceeding or will exceed one or more thresholds. If not the existing gain levels may be maintained, and/or any previously applied gain reductions may possibly be relaxed. However if the predicted temperature rise is not acceptable then the gains gt1-gtn may be adjusted. As with the excursion limiting discussed above any gain change can thus be applied just to the frequency bands that are most of concern.

These gains may be calculated independently for each frequency band, or the gain changes may be so linked as to avoid too severe a distortion of the audio spectrum. The thermal gain control block 1101 may thus act as a thermal controller to determine a thermal gain setting and a gain controller to control the band gains based on the determined thermal gain settings The principles of excursion limiting described previously (in any of the examples discussed above) may be combined with the thermal protection.

Figure 12:
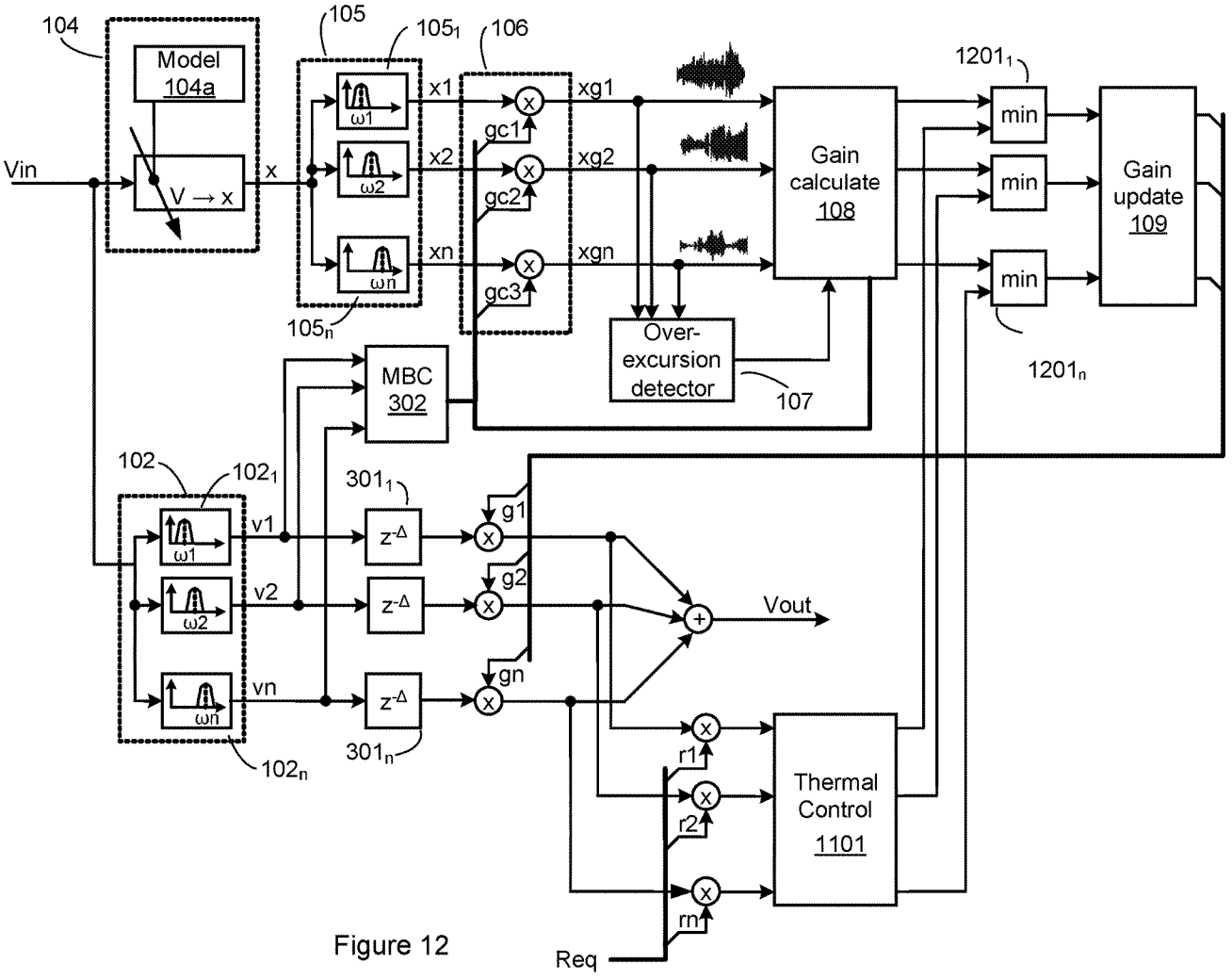
FIG. 12 illustrates a speaker protection block providing combined excursion limiting and thermal protection according to an embodiment.

FIG. 12 illustrates an embodiment which combines a multi-band approaches to excursion limiting and thermal limiting.

In the example of FIG. 12 the band-splitter 102, i.e. filter bank, in the main signal path is used to split the audio signal into bands both for the purposes of allowing band specific gain control and also to provide the inputs for a thermal model, thus avoiding separate main-signal filters for the excursion limiting and thermal protection. It should be noted however that the number of frequency bands required for thermal protection may be less than that required for the excursion protection, so some of the filter outputs may be combined or added before use by the thermal gain control block 1101.

In this embodiment any gain modulation due to the thermal limiter may be combined with the gain limit due to excursion limiting such that there is only a single gain applied to each frequency band of the audio signal. This combination advantageously minimises the manipulation of the signal in the main audio signal path, thus preserving the quality of the audio signal.

FIG. 12 thus illustrates that the main signal path may comprise a band-splitter 102, individual delay elements for each band 301 and a gain block 103 before the signal is recombined to provide the output signal Vout. The main signal path components are thus similar to those discussed above with reference to FIG. 3. FIG. 12 also illustrates that the input signal Vin may also be input to a displacement model block 104 and the band signal input to a secondary band-splitter or filter bank 105 as described above. FIG. 12 also illustrates that an MBC block 302 may act on the band limited audio signals to provide a set of gains gc1-gcn to be applied to the excursion signals x1-xn by the gain block 106. As discussed previously an over-excursion detector 107 may detect whether the total excursion is acceptable and signal the excursion gain calculation block 108 which calculates gains g1-gn to be applied via the gain update block 109.

The gains g1-gn are applied in the signal path by gain block 103. In this embodiment the audio band-limited signals after the gains g1-gn have been applied are tapped and used to derive an estimate of audio power dissipation in each band to be input to the thermal gain control block 1101.

In this embodiment the thermal limit is configured so that it may only reduce the gain calculated by the gain calculation block 108, i.e. the gains calculated for MBC or Excursion limiting purposes, so as to still ensure the speaker excursion is not exceeded. As mentioned the inputs to the thermal limit circuitry are the actual signal components combined and used for the loudspeaker driver, so this is a feedback gain control loop rather than feedforward. The thermal time constants may be long enough to provide the dominant pole to stabilise this loop, even despite any release time constants or delay in the gain update block. The thermal gain control block 1101 may therefore control a bank of limiters $\mathbf{1201}_1$-$\mathbf{1201}_n$ for limiting or reducing the gains calculated by the gain calculation block 108 if necessary.

As discussed above with respect to FIG. 10, in practice it may be adequate to perform excursion limiting using only lower-frequency components of the input audio signal, for instance by splitting the input signal into components above and below some cut-off angular frequency wm. This may give a saving in computational effort or hardware, particularly if the processing of the lower-frequency signals is performed at a lower sample rate.

Figure 13:
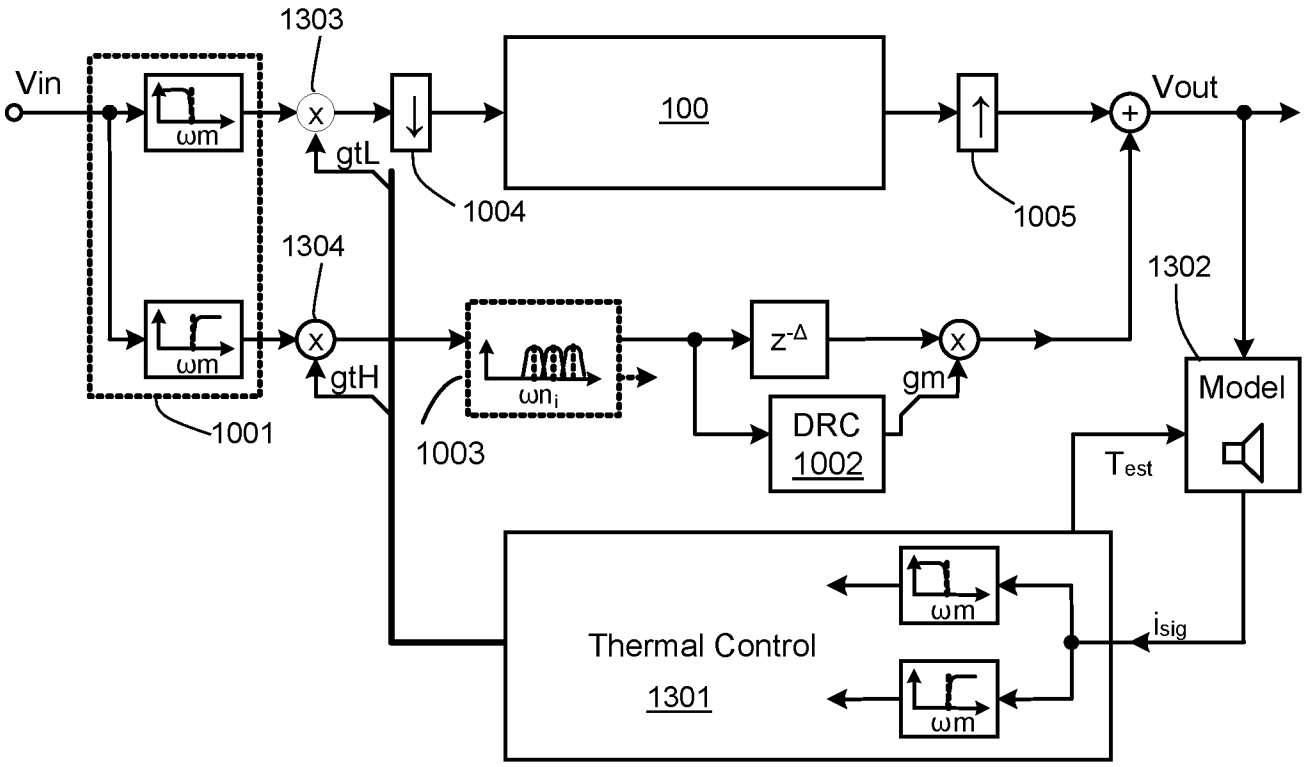
FIG. 13 illustrates an embodiment similar to that illustrated in FIG. 10 with combined thermal speaker protection.

FIG. 13 illustrates an embodiment similar to that illustrated in FIG. 10 where excursion limiting is applied to only some component frequencies. In FIG. 13 components which are similar to those described with reference to FIG. 10 are identified with the same reference numerals. As discussed above a band-splitter 1001 may split the input signal into high and low frequency paths with respect to a cut off frequency ωm and a speaker protection block 100 for excursion limiting may be applied in the low frequency path. In the embodiment of FIG. 13 a thermal control block 1301 determines whether any gain control needs to be applied for thermal protection in similar manner to that described with reference to FIG. 11. In the embodiment of FIG. 13 however the thermal control block 1301 determines the thermal power dissipation for the various bands based on an indication of current. The thermal control block 1301 thus accepts an estimate of the speaker current derived from the digital output voltage signal Vout by an electro-mechanical model 1302, estimates the power and contribution to temperature rise due to components of estimated speaker current above or below the cut-off angular frequency ωm, and thence generates respective gain control factors gtH and gtL, i.e. thermal gain settings, that are applied to gain elements 1303 and 1304 inserted in the high and low-frequency signal paths of the excursion limiter and multi-band compressor circuitry.

Adjusting the signal path gains by these additional gain elements 1303 and 1304 does insert additional signal processing into the signal paths, but under normal operating conditions these gain elements may simply apply a unity gain and thus not distort or otherwise degrade the audio signal quality. Only under near-fault conditions of excessive temperature will any signal modification be necessary, and the rate of change of any gain adjustments will be slow, to compensate for thermal effects with long time constants, typically of the order of seconds, so any artifacts may be minor. The separation of the thermal protection gain adjustment from the excursion limiting and multiband compression adjustments simplifies the design of the system in that the gain update dynamics are now treated separately in separate blocks. The difference in the time constants involved may mean that there is little chance of interaction between the adjustments.

Figure 14:
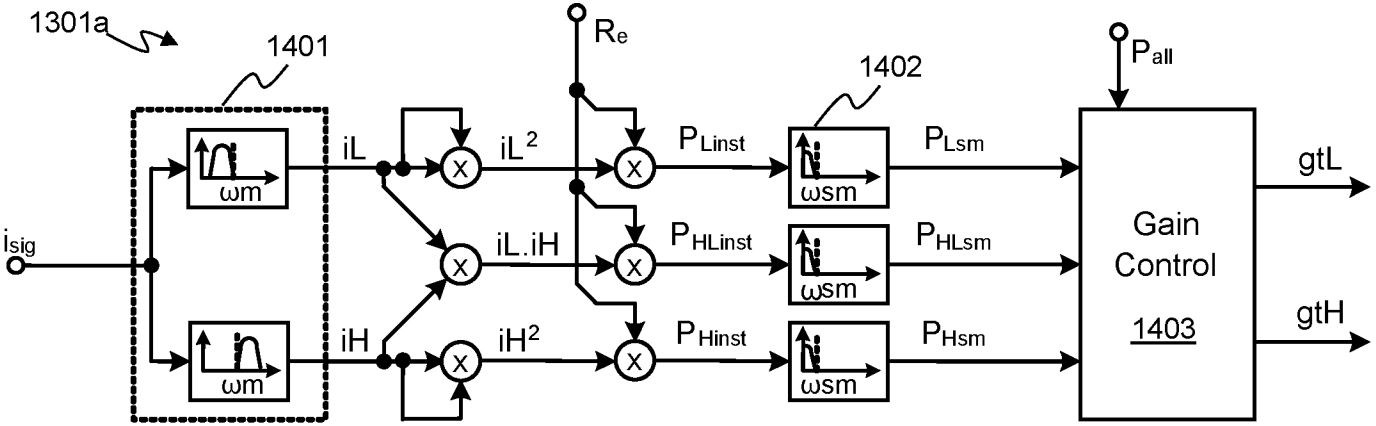
FIG. 14 illustrates circuitry for determining acceptable gain settings from a speaker coil current.

FIG. 14 illustrates one embodiment of thermal limit block 1301, illustrated as 1301*a* in FIG. 14.

The input current signal $i_{sig}$ is split into high frequency and low frequency components iH and iL respectively by a band-splitter 1401, which may, for example, comprise high-pass and low-pass filters, with common cut-off frequency ωm and may incorporate other filtering operations to remove very low or very high frequency components.

The total instantaneous power dissipated by the loudspeaker coil is equal to:

$$(iL+iH)^{2\cdot R}{}_e;$$

where Re is the equivalent series resistance of the voice coil. This may be decomposed into three components, a power dissipation for the low frequency band $P_{Linst}$, a power dissipation for the high frequency band $P_{Hinst}$ and a cross-band power dissipation $P_{HLinst}$ based on the voice current component of both frequency bands:

$$P_{Linst}=iL^2\cdot R_e;$$

$$P_{Hinst}=iH^2\cdot R_e; \text{ and}$$

$$P_{HLinst}=2\cdot iL\cdot iH\cdot R_e.$$

As illustrated in FIG. 14, each of these three power components may be calculated. Each determined power component may then be passed through a respective smoothing filter 1402. It will be noted that since thermal time constants are relatively long, the long-term average of the power is of interest of thermal protection. The smoothing filters 1402 may also incorporate a down-sampling of the signal to a lower data rate for economy of downstream signal processing.

The smoothed power components are then input to a Gain Control block 1403 which compares the total power to a maximum allowable power dissipation $P_{all}$ and derives appropriate gain control factors gtH and gtL for application in the respective upstream signal paths as illustrated in FIG. 13.

Due to the squaring operations, the low-frequency gain factor gtL will have most effect on the $P_{Lsm}$ component, and the high-frequency gain factor gtL will have most effect on the $P_{Hsm}$ component, whereas the third component $P_{HLsm}$ may be equally sensitive to both gain factors. The gain control block 1403 may employ similar gain calculation methods as discussed with respect to the excursion control blocks.

In some applications, for instance where the low-frequency and high-frequency signals are expected to be largely uncorrelated the long-term average of iL·iH may be near zero, and the calculation of this derived signal and the consequent power dissipation calculation may be omitted to save computational effort or hardware.

In some embodiments, there may be more than two major frequency bands and resulting smoothed power dissipation estimate signals.

The maximum allowed power dissipation signal $P_{all}$ may be defined as some predetermined value based on system design or characterisation or manufacturing calibration. However is some embodiments it may be varied during use according to a detected temperature, for instance an estimated voice coil temperature, as illustrated in FIGS. 15*a* and 15*b*. FIGS. 15*a* and 15*b* illustrate a thermal control block 1301 that includes circuitry 1301*a* as described with reference to FIG. 14 but which also operates to derive suitable values of the coil resistance $R_e$ and allowed power dissipation limit $P_{all}$.

In the example of FIG. 15*a* the voice coil current signal $i_{sig}$ is taken before the band-split filtering and squared and multiplied by the coil resistance $R_e$ to provide an estimate of the total instantaneous coil power dissipation $P_{inst}$. This is used, possibly after smoothing and down-sampling, in conjunction with supplied thermal impedance parameters {Zth} to provide an estimated coil temperature $T_{est}$. If $T_{est}$ is at or above some specified maximum temperature Tmax, the allowed power dissipation $P_{all}$ is set to zero. For normal non-faulted operation where the estimated temperature, $T_{est}$, is below this maximum, $T_{max}$, then the allowed power, $P_{all}$, is allowed to be greater than zero, and the further away Test is from $T_{max}$ the higher is $P_{all}$. Thus if the historic signal activity (combined with ambient conditions) has not resulted in substantial heating of the coil of the loudspeaker, then a high output power is allowed. As the coil heats up due to longer-term high-amplitude audio signals, the maximum power allowed is progressively reduced. This allows a higher peak power than would otherwise be the case using a fixed allowable power limit designed for all operating conditions, while avoiding a sudden reduction in signal if the temperature passes $T_{max}$.

The coil temperature $T_{est}$ estimated from the thermal model may also be used to adjust the value of $R_e$ used in the calculations, as this may have a significant temperature coefficient, for instance 5000 ppm/degC. As illustrated in FIG. 13, this estimated coil temperature $T_{est}$ may also be fed back to adjust the parameters of the electromechanical speaker model 1302.

In other embodiments, as illustrated in FIG. 15*b* for example, the estimated temperature $T_{est}$ used to calculate $P_{all}$ may be derived by monitoring an estimate for $R_e$ derived by monitoring the voice coil current and voltage, possibly in conjunction with calculating or adapting other electro-mechanical model parameters of the speaker.

In some embodiments the thermal control speaker current $i_{sig}$ may be derived based on actual measurements of the speaker coil current, rather than an estimate derived from the speaker voltage signal Vout.

Referring back to FIG. 12, it will be noted that in that embodiment the gains determined for multiband dynamic range compression and/or speaker cone excursion limiting may be reduced to provide protection against speaker thermal overload. The gains calculated by Gain Calculation block 108 pass through a bank of minimum function blocks $\mathbf{1201}_1$ to $\mathbf{1201}_n$ whose received inputs also include thermal control gain values from Thermal Control block 1101. The outputs of the minimum function blocks $\mathbf{1201}_1$ to $\mathbf{1201}_n$ provide a set of target gains which are processed by Gain Update block 109 to provide control of the dynamics of the gain values g1 to gn actually applied in the main signal path to provide the output signal Vout.

Thus the gains applied in the main signal path are adjusted in use to provide protection against cone over-excursion and/or voice coil over-temperature. However there may be other reasons for limiting gain. For example in a hand-held device, such as a cellphone or mobile telephone for instance, it may be desired to reduce the audio signal level in a controlled fashion when the user is attempting to provide a voice-input control, or to accommodate other similar "barge-in" use scenarios. The user may also want to controllably temporarily reduce the sound level for other reasons. Further some applications running on the device may also wish to reduce the sound level.

Such volume reductions may be applied upstream of the loudspeaker protection system. However were this the case then it is possible that any upstream gain attenuation applied for other reasons results in any gain reduction applied for speaker protection being relaxed, especially if the loudspeaker protection system is already substantially attenuating the output signal. Thus the net effect may be to maintain the output signal at a similar level despite the upstream attenuation, or at least not provide as much reduction in output signal as desired. Also in a similar fashion a deliberate upstream reduction in the input signal may interact with the multi-band compression subsequently applied and likewise may not provide the expected amount of reduction in the output signal, for example if the compressor may stop compressing and may actually boost the gain as its input signal reduces.

FIG. 16 illustrates an embodiment in which the gains applied in the main signal path may thus be controlled to provide speaker protection and/or multi-band compression but also may be controllably limited in response to additional control signals. FIG. 16 illustrates an audio circuit that includes a loudspeaker protection block 1600 that comprises a Gain Calculation block 108, Thermal Control block 1301 and a bank 103 of gain elements, with structure and operation similar to identically numbered blocks described above. In the embodiment illustrated in FIG. 16 however the gain update block 109 is also responsive to control signals from a controller 1601 as will be described below. Note that FIG. 16 illustrates the gain update block 109 and controller 1601 as separate to the speaker protection block 1600 for clarity but either or both of these functions could in practice be incorporated into the speaker protection block. FIG. 16 also illustrates two speaker protection blocks 1600-L and 1600-R for left and right audio channels respectively.

Referring to the speaker protection block 1600-I for the left audio channel, this block receives an input signal VinL, applies a set of gains {gi}=g1 . . . gn and outputs a signal VoutL. A set of gains geL={geL1 . . . geLn} for excursion limiting is calculated by Gain Calculation block 108 and a set of gains gtL={gtL1 . . . gtLn} for thermal limiting is calculated by the thermal control block 1301. Each respective pair of excursion gains geL1 . . . geLn and thermals gains gtL1 . . . gtLn are applied to inputs of respective minimum blocks $\mathbf{1201}_1$ . . . $\mathbf{1201}_n$ which operate in a similar fashion as described with respect to FIG. 12 to output a set of respective target gains gtgt1 . . . gtgtn for processing by Gain Update block 109, which provides the set of gains {gi} for application in the main signal path.

In this embodiment the bank of minimum function blocks $\mathbf{1201}_1$-$\mathbf{1201}_n$ also have further respective inputs for receiving gain settings from the controller 1601, which may in turn receive one or more of: user inputs from a key board, touch screen or other user interface; control inputs indicating the suspected receipt of a voice trigger phrase; other stimulus indicating activation of a voice-input control function; and control signals from some software application running on the user device.

Each of the bank of minimum function blocks $\mathbf{1201}_1$-$\mathbf{1201}_n$ will thus output the lowest of the set of gain values it receives. Thus any of the inputs may force down the gain in one or more signal frequency bands, overriding the gains suggested at the other inputs.

In some cases, the input gain signals from the controller 1601 may request different gain values for respective frequency bands, in other cases the gain requested may be the same for all frequency bands. Also as discussed above, the number of distinct gain values provided by say the thermal control block may be less than the number of independent frequency bands to which independent gains are applied in the main signal path, in which case the same thermal control gain signal may be applied to more than one minimum block.

As noted above in some embodiments, there may be more than one audio signal channel, e.g. for stereo applications, as illustrated in FIG. 15 by parallel speaker protection block 1600-R. The gain control signals generated by this parallel speaker protection block 1600-R are applied to the minimum function blocks $\mathbf{1201}_1$ . . . 1201n in a similar fashion to the equivalent gain signals from the other channel (note FIG. 16 only illustrates excursion gains being generated by this speaker protection block 1600-R for the right audio channel but in practice there may also be thermal gains for thermal protection). In some embodiments a common gain signal [gi] may be applied to both channels, this gain being the smaller of the respective gains required in each individual channel. In this way protection is provided without altering the balance between the two channels.

Embodiments of the invention therefore provide methods and apparatus for loudspeaker protection that can provide excursion limiting and/or thermal protection. Embodiments use a multiband approach to determine the contribution from each of a plurality of frequency bands, e.g. determine the excursion and/or power dissipation for each of the bands. The overall excursion or temperature can be determined and compared to one or more acceptable limits or thresholds. If a relevant threshold is or will be exceeded a gain reduction can be applied to the bands of most concern. This means that only those frequency bands that may cause a problem may need to be attenuated, thus preserving as much as possible of the original signal and preserving for example loudness. In some instances gain reduction may be applied to bands in a co-ordinated manner to preserve some signal relationship, e.g. for psychoacoustic properties. The speaker protection can also combine excursion limiting and/or thermal protection with dynamic range compression such as multi-band compression without competition between the speaker protection and/or compression resulting in undue or inefficient use of computational resources with associated power wastage and without introducing audio artifacts.

It should be noted that the embodiments described above have described the application of multi-band compression where there may be different gains applied to different frequency bands based on the signal components in each frequency band for dynamic range control over the various frequency bands. In some instances however the excursion and/or thermal protection may be performed on multiple frequency bands but the dynamic range processing may be effectively single band, i.e. conventional dynamic range control. It will also be appreciated that the term multi-band compression does not imply that the signal in any band is also attenuated and the signal in at least some bands may be amplified as part of multi-band compression.

In some embodiments the gain calculation circuitry may be temporarily disabled, for example the clocks may be removed from some or all of the relevant circuitry, should it be detected that the power dissipated in the coil or the predicted excursion is well below some threshold. Such disablement may reduce computational overhead when not required and reduce power consumption.

Although described in terms of the excursion of a loudspeaker cone, the invention is applicable to many types of audio output transducer. Applicable transducers may comprise various types of mechanical member of various geometries whose movement requires to be constrained to prevent damage or degradation over time, and may include motor elements other than electromagnetic coils, for example piezo-electric drivers.

The protection circuitry described above may be incorporated in audio amplifier circuitry in portable battery-powered devices such as mobile phones, tablets or lap-top computers or suchlike. It may also be used in speakerphones, mains-powered music or PA amplifiers, audio amplifier s in automobiles and other transport apparatus.

FIG. 17 illustrates an embodiment of an apparatus 1700 incorporating the speaker protection system according to the present invention.

The apparatus, for example a mobile phone or tablet, comprises the speaker protection system 1701, which may be a system as described in any of the embodiments above. The speaker protection system 1701 is arranged to receive an audio signal either from an internal signal source 1702 or an external source.

An internal signal source 1702 may comprise a memory, e.g. a solid state memory, arranged to store media with an audio component, such as music or video, for playback via the speaker protection system 1701 and drive amplifier 1703 and finally at least one speaker 1704, which may be an internal speaker of the device or may be part of a peripheral apparatus which is connected to the apparatus in use.

An external source may comprise a communications network such as those used for mobile and wireless communications wherein the apparatus has a receiver 1705 to receive a voice call or media file for playback via the speaker protection system 1701 and drive amplifier 1703 and finally at least one speaker 1704.

It will be appreciated by those skilled in the art that during a voice call there are timing and latency requirements that are beyond the control of the apparatus. Thus as mentioned previously any signal processing in the signal path between the receiver 1705 and speaker 1704 should not introduce any significant delay. As mentioned previously the embodiments described above provide speaker protection that introduces only relatively low delays which will typically be within any allowable latency limits.

The speaker protection system 1701 may receive one or more feedback signals from the speaker for directly determining the displacement of the speaker itself and that are used to set the parameters of the displacement model within speaker protection system. Such feedback signals may, for example comprise current and/or voltage signals.

In some embodiments the speaker protection system may receive one or more pre-programmed signals relating to operation of the speaker protection system. Such signals may be based on data, settings or code that is internally stored, for example in a memory 1706. Such settings or data may be stored during manufacturing or during use in a calibration routine, e.g. as performed periodically or on power-up or reset. Such signals may be used to set at least some parameters of the speaker protection, such as attack or decay constant to be applied to gain changes etc, or data regard the displacement model within speaker protection system.

It will of course be appreciated that various embodiments of speaker protection block as disclosed or various blocks or parts thereof may be co-integrated with other blocks or parts thereof or with other functions of a host device on an integrated circuit such as a Smart Codec.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware Embodiments of the invention may be arranged as part of an audio processing circuit, for instance an audio circuit which may be provided in a host device. A circuit according to an embodiment of the present invention may be implemented as an integrated circuit. One or more loudspeakers may be connected to the integrated circuit in use.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

The invention claimed is:

1. A loudspeaker protection system comprising:

a first frequency band-splitter configured to receive an input audio signal and split said input audio signal into a plurality of audio signals in different respective frequency bands;

a first gain block configured to apply a respective frequency band gain to each of said plurality of audio signals in said different respective frequency bands;

a gain controller for controlling said respective frequency band gains; and a displacement modeller configured to determine a plurality of displacement signals based on said input audio signal and a displacement model, each displacement signal corresponding to a modelled cone displacement for the loudspeaker for one of said different respective frequency bands;

wherein said gain controller is configured to control said respective frequency band gains based on said plurality of displacement signals.

2. A loudspeaker protection system as claimed in claim 1 wherein the displacement modeller comprises a displacement modelling block configured to receive an audio waveform signal and determine a predicted displacement for the loudspeaker based on said audio waveform signal and the displacement model.

3. A loudspeaker protection system as claimed in claim 2 wherein said audio waveform signal is a version of said input audio signal.

4. A loudspeaker protection system as claimed in claim 2 wherein the displacement modeller comprises a second frequency band-splitter configured to receive the output of said displacement modelling block and split said output into the plurality of displacement signals in different frequency bands, wherein said frequency bands of the second frequency band-splitter correspond to the frequency bands of the first frequency band-splitter.

5. A loudspeaker protection system as claimed in claim 2 wherein said displacement modelling block is configured to receive said plurality of audio signals output from said first frequency band splitter and determine a modelled cone displacement for each of said audio signals output from said first frequency band splitter to provide the plurality of displacement signals in different frequency bands.

6. A loudspeaker protection system as claimed in claim 1, comprising a second gain block configured to apply a respective gain to each of said plurality of displacement signals in different frequency bands, wherein the respective gain applied to each of said plurality of displacement signals by said second gain block is based on the then present band gain corresponding to that frequency band as determined by the gain controller.

7. A loudspeaker protection system as claimed in claim 6 further comprising a multi-band dynamic range control block wherein the respective gain applied to each of said plurality of displacement signals by said second gain block is based on a dynamic range control gain for the relevant frequency band determined by said multi-band dynamic range control block.

8. A loudspeaker protection system as claimed in claim 6 comprising an over-excursion detector configured to determine whether an overall predicted cone excursion for said loudspeaker based on said plurality of displacement signals after the respective gain has been applied by said second gain block is or will exceed at least one threshold.

9. A loudspeaker protection system as claimed in claim 8 wherein the over-excursion detector is configured to receive and combine said plurality of displacement signals after the respective gain has been applied by said second gain block to determine the overall predicted cone excursion for said loudspeaker.

10. A loudspeaker protection system as claimed in claim 1 wherein the gain controller is configured to control the band gain for each frequency band based on the displacement signal for that frequency band.

11. A loudspeaker protection system as claimed in claim 10 wherein said gain controller is configured to control said band gains to maximise a sum of the band gains subject to remaining within an acceptable excursion limit.

12. A loudspeaker protection system as claimed in claim 11 wherein said gain controller is configured to apply iterative error minimisation techniques to control said band gains.

13. A loudspeaker protection system as claimed in claim 10 wherein said gain controller is configured to identify a threshold of cone displacement based on the plurality of displacement signals and to control the band gains so that, for any frequency band where the displacement signal corresponds to a predicted cone displacement greater than the threshold, the gain for said frequency band is controlled to reduce the predicted cone displacement to be equal to the threshold.

14. A loudspeaker protection system as claimed in claim 8 wherein said gain controller is configured to apply a weighting to the contribution from one or more frequency bands.

15. A loudspeaker protection system as claimed in claim 1 wherein at least one frequency band of the plurality of audio signals output from the first frequency band splitter corresponds to a non-excursion limited frequency band where the respective band gain is not based on said plurality of displacement signals.

16. A loudspeaker protection system as claimed in claim 1 further comprising a thermal controller configured to determine a power dissipation for the loudspeaker in each of a plurality of thermal frequency bands and determine, for each thermal frequency band, a respective thermal gain setting based on the determined power dissipation for that frequency band, wherein at least some of the thermal frequency bands correspond to the frequency bands of the plurality of audio signals output from the first band-splitter, and wherein said gain controller is configured to further control said band gains based on said determined power dissipation for said loudspeaker for said frequency bands.

17. A loudspeaker protection system as claimed in claim 16 wherein said gain controller comprises:

an excursion gain calculation block for determining an excursion gain setting for each frequency band; and a minimum function block configured to receive, for each frequency band, the excursion gain setting and thermal gain setting as gain setting inputs and determine the relevant band gain based on the minimum gain setting input for that frequency band.

18. An electronic apparatus comprising a loudspeaker protection system, the loudspeaker protection system comprising:

a first frequency band-splitter configured to receive an input audio signal and split said input audio signal into a plurality of audio signals in different respective frequency bands;

a first gain block configured to apply a respective frequency band gain to each of said plurality of audio signals in said different respective frequency bands;

a gain controller for controlling said respective frequency band gains; and a displacement modeller configured to determine a plurality of displacement signals based on said input audio signal and a displacement model, each displacement signal corresponding to a modelled cone displacement for the loudspeaker for one of said different respective frequency bands;

wherein said gain controller is configured to control said respective frequency band gains based on said plurality of displacement signals, and wherein said apparatus is at least one of: a portable device; a battery power device; a computing device; a communications device; a gaming device; a mobile telephone; a personal media player; a laptop, tablet or notebook computing device.

19. A method of loudspeaker protection comprising:

receiving an input audio signal;

splitting said input audio signal into a plurality of audio signals in different frequency bands; and applying a respective band gain to each of said plurality of audio signals in different frequency bands;

wherein the method comprises determining a modelled cone displacement for the loudspeaker for each of a plurality of said frequency bands; and controlling said band gains based on said modelled cone displacement for said frequency bands.

20. An article of manufacture, comprising:

a non-transitory storage medium; and computer-executable instructions carried on the non-transitory storage medium, the instructions readable by a processor, the instructions, when read and executed, for causing the processor perform a method of loudspeaker protection, the method comprising:

receiving an input audio signal;

splitting said input audio signal into a plurality of audio signals in different frequency bands; and applying a respective band gain to each of said plurality of audio signals in different frequency bands;

wherein the method comprises determining a modelled cone displacement for the loudspeaker for each of a plurality of said frequency bands; and controlling said band gains based on said modelled cone displacement for said frequency bands.

* * * * *